United States Patent [19]

Inoue et al.

[11] Patent Number: 4,981,780

[45] Date of Patent: Jan. 1, 1991

[54] DIRECT POSITIVE PHOTOGRAPHIC LIGHT-SENSITIVE MATERIAL

[75] Inventors: Noriyuki Inoue; Shigeo Hirano, both of Kanagawa, Japan

[73] Assignee: Fuji Photo Film Co., Ltd., Kanagawa, Japan

[21] Appl. No.: 278,920

[22] Filed: Dec. 2, 1988

[30] Foreign Application Priority Data

Dec. 2, 1987 [JP] Japan ..... 62-304996

[51] Int. Cl.[5] ..... G03C 1/785

[52] U.S. Cl. ..... 430/598; 430/604; 430/605; 430/567

[58] Field of Search ..... 430/598, 604, 605, 567

[56] References Cited

U.S. PATENT DOCUMENTS

| | | | |
|---|---|---|---|
| 3,850,637 | 11/1974 | Evans | 430/409 |
| 4,115,122 | 7/1978 | Adachi | 430/596 |
| 4,395,478 | 7/1983 | Hoyen | 430/217 |
| 4,581,328 | 4/1986 | Matsuyama | 430/567 |
| 4,643,965 | 10/1987 | Kubota | 430/567 |

FOREIGN PATENT DOCUMENTS

| | | |
|---|---|---|
| 0276842 | 8/1988 | European Pat. Off. . |
| 2655870 | 6/1977 | Fed. Rep. of Germany . |
| 3419481 | 12/1984 | Fed. Rep. of Germany . |

*Primary Examiner*—Paul R. Michl
*Assistant Examiner*—Janet C. Baxter
*Attorney, Agent, or Firm*—Sughrue, Mion, Zinn, Macpeak & Seas

[57] ABSTRACT

A direct positive photographic light-sensitive material comprising: (1) a support, (2) at least one photographic emulsion layer containing internal latent image type silver halide grains not having been previously fogged, wherein the internal latent image type silver halide grains are silver bromide, silver chloride, silver iodobromide, silver chlorobromide or silver chloroiodobromide grains in which at least one metal selected from manganese, copper, zinc, cadmium, lead, bismuth, indium, thallium, zirconium, lanthanum, chromium, rhenium, and metals of group VIII of the Periodic Table is incorporated, and (3) at least one compound represented by the following formula (N-1):

(N-1)

wherein $Z^1$ represents a nonmetallic atomic group necessary to form a 5-membered or 6-membered heterocyclic ring to which an aromatic ring or a heterocyclic ring may further be condensed; $R^1$ represents an aliphatic group; X represents =C— or —N—; Q represents a nonmetallic atomic group necessary to form a 4-membered to 12-membered nonaromatic hydrocarbon ring or nonaromatic heterocyclic ring; at least one of $R^1$, a substituent for $Z^1$ and a substituent for Q includes an alkynyl group; Y represents a counter ion necessary for charge balance; and n represents a number necessary to balance a charge.

22 Claims, No Drawings

DIRECT POSITIVE PHOTOGRAPHIC LIGHT-SENSITIVE MATERIAL

FIELD OF THE INVENTION

The present invention relates to a photographic light-sensitive material and, more particularly, to a direct positive photographic light-sensitive material which provides excellent gradation.

BACKGROUND OF THE INVENTION

Photographic processes for obtaining direct positive images without employing a reversal processing step or a negative film are well known.

Taking practical utility into consideration, conventional techniques for obtaining a positive image from a direct positive silver halide photographic light-sensitive material, exclusive of certain special methods, are divided chiefly into the following two types.

One type employs a previously fogged silver halide emulsion whose fog centers (latent image) in exposed areas are destroyed making use of the solarization or Herschell effect to obtain a direct positive, after development.

The other type uses an internal latent image type silver halide emulsion not having been fogged, which is imagewise exposed to light and then subjected to surface development either after fogging treatment or during fogging treatment to obtain a direct positive. The internal latent image type silver halide emulsion used herein is such an emulsion in which silver halide grains have sensitivity specks predominantly in the interior thereof and form a latent image predominantly in the interior upon exposure to light.

The methods belonging to the latter type generally enjoy higher sensitivity and are suitable for uses requiring high sensitivity as compared with the methods of the former type. The present invention belongs to the latter type.

Various techniques of this type have been known, such as those disclosed, for example, in U.S. Pat. Nos. 2,592,250, 2,466,957, 2,497,875, 2,588,982, 3,317,322, 3,761,266, 3,761,276 and 3,796,577, and British Patent Nos. 1,151,363, 1,150,553 and 1,011,062. According to these conventional techniques, photographic materials providing a direct positive image with relatively high sensitivity can be produced.

For the details of the direct positive image formation mechanism, reference can be made to, for example, T.H. James, *The Theory of the Photographic Process,* 4th Ed. (1979), Chap. 7, pp. 182 to 193 and U.S. Pat. No. 3,761,276.

It is believed that a direct positive image is formed through the following mechanism: First, imagewise exposure results in the formation of an internal latent image (positive hole) in the interior of silver halide grains, which leads to the formation of fog centers selectively on the surface of the unexposed silver halide grains by surface desensitization based on the internal latent image, and subsequent conventional surface development processing results in formation of a photographic image (a direct positive image) on the unexposed area.

Selective formation of fog centers can be generally effected by a "light fogging method" in which the entire surface of a light-sensitive layer is secondarily exposed to light as described, for example, in British Patent No. 1,151,363 or a "chemical fogging method" using a nucleating agent described, for example, in *Research Disclosure,* Vol. 151, No. 15162 (November, 1976), pp. 76 to 78.

In the formation of a direct positive color image, the internal latent image type silver halide light-sensitive material is subjected to surface color development processing either after or simultaneously with fogging treatment and then subjected to bleaching and fixing (or bleach-fixing), After the bleaching and fixing processing, the material is usually washed with water and/or subjected to stabilizing processing.

In the chemical fogging method hitherto used, nucleating agents which exhibit their effective nucleating function only at a high pH range of 12 or higher are employed. Under such a high pH condition, the developing agent is more susceptible to deterioration due to air oxidation, so that development activity becomes seriously reduced. Further, the rate of development is low and thus a long processing time is required. Particularly, in case of using a developing solution of a low pH, the processing time becomes much long.

On the other hand, the light fogging method does not require a high pH condition and, therefore, enjoys a relatively practical advantage. However, this method encounters various technical problems when applied to a broad photographic field for various purposes. More specifically, since this method is based on the formation of fog centers by photolysis of silver halide, the optimum illumination or exposure varies depending on the kind and characteristics of the silver halide used. It is, therefore, difficult to assure predictable performance. In addition the development apparatus required is complicated and expensive.

Hydrazine compounds are well known as nucleating agents which are employed in the above-described chemical fogging method In general, hydrazine type nucleating agents are excellent in view of discrimination since they provide a large difference between maximum density (Dmax) and minimum density (Dmin). However, they are disadvantageous because they require processing at a high pH (pH $>12$).

As nucleating agents which function in processing at a low pH (pH $\leqq 12$), heterocyclic quaternary ammonium salts are known and described, for example, in U.S. Pat. Nos. 3,615,615, 3,719,494, 3,734,738, 3,759,901, 3,854,956, 4,094,683 and 4,306,016, British Patent No. 1,283,835, JP-A-52-3426 and JP-A-52-69613 (the term "JP-A" as used herein refers to a "published unexamined Japanese patent application"). Particularly, propargylor butynyl-substituted heterocyclic quaternary ammonium salt compounds described in U.S. Pat. No. 4,115,122 are excellent nucleating agents in view of discrimination when used in direct positive silver halide emulsions. However, in silver halide emulsions wherein sensitizing dyes are employed for the purpose of spectral sensitization, competitive adsorption of the sensitizing dyes and the heterocyclic quaternary ammonium type nucleating agents onto silver halide grains takes place, and thus, it is necessary to add a large amount of the quaternary ammonium salt type nucleating agents which are of low adsorptivity. In particular, in the case of multilayer color photographic light-sensitive materials, unevenness of density and destruction of color balance may undesirably occur. Therefore, these compounds are still insufficient. The above-described problems tend to become remarkable during storage under high temperature and high humidity conditions.

In order to resolve the above-described problem, quaternary salt type nucleating agents having an AgX adsorption accelerating thioamido group are disclosed in U.S. Pat. No. 4,471,044. Although the amount to be added necessary to obtain a sufficiently high Dmax is reduced and the decrease in Dmax during storage at high temperature is controlled by introduction of the adsorptive group, these effects still do not achieve to a fully satisfactory level.

SUMMARY OF THE INVENTION

It is, therefore, an object of the present invention to provide a direct positive photographic light-sensitive material which exhibits high maximum image density, low minimum image density and high gradient at a toe region of the characteristic curve.

Another object of the present invention is to provide a direct positive photographic light-sensitive material which undergoes less change in photographic properties such as decrease in the maximum image density and increase in the minimum image density during storage of the photographic light-sensitive material under high temperature and/or high humidity conditions.

Other objects of the present invention will become apparent from the following description and examples.

These objects of the present invention are accomplished with a direct positive photographic light-sensitive material comprising: (1) a support, (2) at least one photographic emulsion layer containing internal latent image type silver halide grains not having been previously fogged, wherein the internal latent image type silver halide grains are silver bromide, silver chloride, silver iodobromide, silver chlorobromide or silver chloroiodobromide grains in which at least one metal selected from manganese, copper, zinc, cadmium, lead, bismuth, indium, thallium, zirconium, lanthanum, chromium, rhenium, and metals of group VIII of the Periodic Table is incorporated, and (3) at least one compound represented by the following formula (N-1):

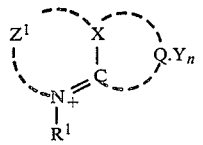

(N-1)

wherein $Z^1$ represents a nonmetallic atomic group necessary to form a 5-membered or 6-membered heterocyclic ring to which an aromatic ring or a heterocyclic ring may further be condensed; $R^1$ represents an aliphatic group; X represents $$=\underset{|}{C}- \quad \text{or} \quad -\underset{|}{N}-;$$

Q represents a nonmetallic atomic group necessary to form a 4-membered to 12-membered non-aromatic hydrocarbon ring or nonaromatic heterocyclic ring; at least one of $R^1$, a substituent for $Z^1$ and a substituent for Q includes an alkynyl group; Y represents a counter ion necessary for charge balance; and n represents a number necessary to balance a charge.

DETAILED DESCRIPTION OF THE INVENTION

It is known that the formation of a re-reversal negative image is restrained by incorporating a metal such as manganese, copper, zinc, cadmium, etc., into internal latent image type silver halide grains not having been previously fogged as described in U.S. Pat. No. 4,395,478. However, in accordance with the present invention the unexpected effect is achieved that high maximum density and low minimum density are obtained as well as realizing high gradient at a highlight portion by means of also using a compound having a nucleating function represented by the formula (N-1) described above.

The photographic emulsion layer containing internal latent image type silver halide grains not having been previously fogged which can be used in the present invention includes an emulsion containing silver halide grains whose surfaces have not been previously fogged, and which form latent images predominantly in the interior of grains. More specifically, suitable emulsions have the characteristic that when coated on a transparent support in a predetermined amount ranging from 0.5 $g/m^2$ to 3 $g/m^2$ in terms of silver, exposed for a fixed time between 0.01 and 10 seconds, then developed at 18° C. for 5 minutes in the following Developing Solution A (internal developer), provide a maximum density (measured by a conventional photographic density measuring method) of at least about 5 times, more preferably at least about 10 times, as much as that obtained by coating and exposing the emulsion in the same manner as described above, but developing at 20° C. for 6 minutes in the following Developing Solution B (surface developer):

| | |
|---|---|
| Internal Developer A: | |
| Metol | 2 g |
| Sodium Sulfite (anhydrous) | 90 g |
| Hydroquinone | 8 g |
| Sodium Carbonate (monohydrate) | 52.5 g |
| KBr | 5 g |
| KI | 0.5 g |
| Water to make | 1 liter |
| Surface Developer B: | |
| Metol | 2.5 g |
| l-Ascorbic Acid | 10 g |
| $NaBO_2.4H_2O$ | 35 g |
| KBr | 1 g |
| Water to make | 1 liter |

Specific examples of the internal latent image type emulsions include conversion type silver halide emulsions as described, for example, in U.S. Pat. No. 2,592,250, and conversion type silver halide emulsions described, for example, in U.S. Pat. Nos. 3,761,276, 3,850,637, 3,923,513, 4,035,185, 4,395,478 and 4,504,570, JP-A-52-156614, JP-A-55-127549, JP-A-53-60222, JP-A-56-22681, JP-A-59-208540, JP-A-60-107641, JP-A-61-3137, JP-A-62-215272, and the patents cited in *Research Disclosure,* No. 23510 (November, 1983), page 236.

Although the internal latent image type silver halide grains used in the present invention may be conversion type emulsions or core/shell type emulsions, those having a core/shell stratified form are preferred from the standpoint of easy control of photographic sensitivity, gradation, etc. The core and shell thereof are preferably composed of silver bromide, silver iodobromide, silver chlorobromide or silver chloroiodobromide containing silver bromide and not more than about 10 mol%, preferably not more than about 3 mol%, of silver iodide. The core may be a so-called conversion type or a conventional grain. The halogen composition of core and shell may be the same or different. Suitable examples of silver halide emulsions having a core/shell structure which can be used are described, for example, in JP-A-55-127549, U.S. Pat. No. 4,395,478 and West German Patent No. 2,332,802 C2.

The amount of the metal selected from manganese, copper, zinc, cadmium, lead, bismuth, indium, thallium, zirconium, lanthanum, chromium, rhenium and metals of group VIII of the Periodic Table incorporated into silver halide grains according to the present invention is preferably from about $10^{-9}$ to about $10^{-2}$ mol, more preferably from about $10^{-6}$ to about $10^{-3}$ mol, per mol of silver halide.

Of the above-described metals, magnesium, copper, zinc, cadmium, lead, bismuth and metals of group VIII of the Periodic Table are preferred, and lead, iridium and bismuth are particularly preferably employed.

The position at which the above-described metal is incorporated in the latent image type silver halide grains not having been previously fogged employed in the present invention is not particularly restricted. However, it is preferred to incorporate it into the core in the case of using internal latent image type grains having a core/shell stratified structure.

The metal can be incorporated into silver halide grains by means of coexistence thereof in the form of an aqueous solution or an organic solvent solution of the metal ion at the formation of the silver halide grains by mixing of an aqueous solution of silver ion and an aqueous solution of halide. Alternatively, after the formation of the silver halide grains, the metal ion can be added to the emulsion in the form of an aqueous solution or an organic solvent solution and then the silver halide grains are further covered with silver halide.

The methods for incorporation of such a metal are also described in U.S. Pat. Nos. 3,761,276 and 4,395,478 and JP-A-59-216136.

The average grain size (the grain size being defined as the diameter of the grains when the grain has a sphericil or a nearly spherical form and as the length of the edge when the grain has a cubic form, and being averaged based on the projected area of the grains) of the silver halide grains is preferably up to about 1.5 μm from about 0.1 μm, and particularly preferably from about 0.2 μm to about 1.2 μm. Although the distribution of the grain size may be either broad or narrow, in order to improve graininess and sharpness, it is preferred in the present invention to use a so-called "monodispersed" silver halide emulsion having a narrow grain size distribution such that about 90% or more, particularly about 95% or more of all the grains fall within ± about 40%, more preferably ± about 30% and most preferably ± about 20%, of the average grain size, in terms of grain number or weight.

In order to satisfy the gradation required for the photographic light-sensitive material, in emulsion layers having substantially the same color sensitivity, two or more monodispersed silver halide emulsions different in grain size or a plurality of grains of the same size but different in sensitivity are mixed in the same layer or are applied as different layers that are superposed. Two or more polydispersed silver halide emulsions or a monodispersed silver halide emulsion and a polydispersed silver halide emulsion can be used in the form of a mixture or in superposed layers.

The silver halide grains used in the present invention may be regular crystals such as cubic, octahedral, dodecahedral or tetradecahedral crystals or irregular crystals such as spherical crystals, or may have a composite form of these crystal forms. Further, tabular silver halide grains having a diameter/thickness ratio of at least 5, particularly at least 8, which account for at least about 50% of the total projected area of the silver halide grains may be used. Moreover, an emulsion composed of a mixture of these various crystals may be employed.

In the silver halide emulsion used in the present invention, the interior or the surface of the grains may be chemically sensitized by sulfur sensitization, selenium sensitization, reduction sensitization or noble metal sensitization, that can be used alone or in combination. Specific examples of useful chemical sensitization method are described, for example, in the patents cited in *Research Disclosure,* No. 17643-III (December, 1978), page 23.

The photographic emulsion used in the present invention is spectrally sensitized with a photographic sensitizing dye in a conventional manner. Particularly useful dyes are cyanine dyes, merocyanine dyes and complex merocyanine dyes, which may be used alone or in combination, and also can be used in combination with supersensitizers. Specific examples thereof are described, for example, in the patents cited in *Research Disclosure,* No. 17643-IV (December, 1978), pages 23 and 24.

The photographic emulsions used in the present invention can contain an antifoggant or a stabilizer for the purpose of stabilizing the photographic performance, or of preventing formation of fog during the production, storage or photographic processing of the photographic light-sensitive material. Specific examples of anti-foggants and stabilizers are described, for example, in *Research Disclosure,* No. 17643-VI (December, 1978), and E.J. Birr, *Stabilization of Photographic Silver Halide Emulsions,* 1974 (Focal Press).

Now, the compound represented by the formula (N-1) is described in more detail below.

In the formula (N-1), at least one of $R^1$, $Z^1$ and Q may include a group capable of accelerating adsorption onto silver halide grains.

The heterocyclic ring (including the condensed ring) which is completed with $Z^1$ include, for example, a a quinolinium nucleus, a benzimidazolium nucleus, a pyridinium nucleus, a thiazolium nucleus, a selenazolium nucleus, an imidazolium nucleus, a tetrazolium nucleus, an indolenium nucleus, a pyrrolinium nucleus, an acridinium nucleus, a phenanthridinium nucleus, an isoquinolium nucleus, and a naphthopyridinium nucleus.

The heterocyclic ring and condensed ring thereto which is completed with $Z^1$ may be substituted. Examples of the substituents include an alkyl group, an alkenyl group, an aralkyl group, an aryl group, an alkynyl group, a hydroxyl group, an alkoxy group, an aryloxy group, a halogen atom, an amino group, an alkylthio group, an arylthio group, an acyloxy group, an acylamino group, a sulfonyl group, a sulfonyloxy group, a sulfonylamino group, a carboxyl group, an acyl group, a carbamoyl group, a sulfamoyl group, a sulfo group, a cyano group, a ureido group, a urethane group, a carbonic acid ester group, a hydrazine group, a hydrazone group and an imino group.

As the substituent for $Z^1$, at least one is selected, for example, from the above-described substituents. When two or more substituents are present, they may be the same or different. The above-described substituents in turn may be further substituted with one or more of these substituents.

Further, the substituent for $Z^1$ may be a heterocyclic ring quaternary ammonium group completed with $Z^1$ via a suitable linking group $L^1$. In this case, it forms a dimer structure. $L^1$ is described in more detail below.

The heterocyclic ring skeleton completed with $Z^1$ is preferably a quinolinium nucleus, a benzimidazolium nucleus, a pyridinium nucleus, an acridinium nucleus, a phenanthridinium nucleus, a naphthopyridinium nucleus or an isoquinolinium nucleus, with a quinolinium nucleus, a naphthopyridinium nucleus and a benzimidazolium nucleus being more preferred and a quinolinium nucleus being most preferred.

The aliphatic group represented by $R^1$ includes an unsubstituted alkyl group having from 1 to 18 carbon atoms or a substituted alkyl group having from 1 to 18 carbon atoms in the alkyl moiety. The substituents may be the same as those described for $Z^1$.

For $R^1$, an alkynyl group is preferred, and a propargyl group is particularly preferred.

Q represents a nonmetallic atomic group necessary to form a 4-membered to 12-membered nonaromatic hydrocarbon ring or nonaromatic heterocyclic ring. These rings may be substituted with one or more substituents as described for $Z^1$.

Examples of the nonaromatic hydrocarbon ring wherein X represents a carbon atom include a cyclopentane ring, a c-yclohexane ring, a cyclohexene ring, a cycloheptane ring, an indan ring and a tetralin ring.

The nonaromatic heterocyclic ring includes, as a hetero atom, for example, a nitrogen atom, an oxygen atom, a sulfur atom and a selenium atom.

Examples of the nonaromatic heterocyclic ring wherein X represents a carbon atom include a tetrahydrofuran ring, a tetrahydropyran ring, a butyrolactone ring, a pyrrolidone ring and a tetrahydrothiophene ring.

Examples of the nonaromatic heterocyclic ring wherein X represents a nitrogen atom include a pyrrolidine ring, a piperidine ring, a pyridone ring, a piperazine ring, a perhydrothiazine ring, a tetrahydroquinoline ring and an indoline ring.

Preferred examples of the ring completed with Q are those wherein X represents a carbon atom. Particularly, a cyclopentane ring, a cyclohexane ring, a cycloheptane ring, a cyclohexene ring, an indan ring, a tetrahydropyran ring and a tetrahydrothiophene ring are preferred for the ring completed with Q.

The alkynyl group which is present as at least one of $R^1$, a substituent for $Z^1$ or a substituent for Q has been partially described. In more detail, the alkynyl group preferably contains from 2 to 18 carbon atoms and may be an ethynyl group, a propargyl group, a 2-butynyl-group, a 1-methylpropargyl group, a 1,1-dimethylpropargyl group, a 3-butynyl group or a 4-pentynyl group.

These may further be substituted with those substituents which have been described as substituents for $Z^1$.

Of the alkynyl group, a propargyl group is preferred, and it is most preferred that $R^1$ is a propargyl group.

The group capable of accelerating adsorption by silver halide grains which may be present in $R^1$, Q or $Z^1$ is preferably a group represented by the following formula:

$$X^1(L^1)_m-$$

wherein $X^1$ represents a group capable of accelerating adsorption by silver halide grains; $L^1$ represents a divalent linking group; and m represents 0 or 1.

Preferred examples of the group capable of accelerating adsorption by silver halide include a thioamido group, a mercapto group and a 5-membered or 6-membered nitrogen-containing heterocyclic group. These groups may be substituted with one or more substituents as those described for $Z^1$. Of the thioamido group, an acyclic thioamido group (for example, thiourethane, thioureido) is preferred.

The mercapto group represented by $X^1$ is particularly preferably a heterocyclic mercapto group (for example, 5-mercaptotetrazole, 3-mercapto-1,2,4-triazole, 2-mercapto-1,3,4-thiadiazole, 2-mercapto-1,3,4-oxadiazole).

The 5-membered or 6-membered nitrogen-containing heterocyclic ring represented by $X^1$ contains a combination of nitrogen, oxygen, sulfur and carbon and preferably is one that will form an imino silver such as benzotriazole or aminothiatriazole.

The divalent linking group represented by $L^1$ in the above-described formula is an atom or atomic group containing at least one of C, N, S and O. Specifically, $L^1$ comprises an alkylene group, an alkenylene group, an alkynylene group, an arylene group, -O-, -S-, -NH-, -N=, -CO-, $-SO_2-$ (these groups optionally having one or more substituents), or a combination thereof. Specific examples of preferred combinations include $$-\overset{O}{\overset{\|}{C}}O-,\ -\overset{O}{\overset{\|}{C}}NH-,\ -SO_2NH-,\ -O\overset{O}{\overset{\|}{C}}NH-,\ -NH\overset{O}{\overset{\|}{C}}NH-,$$

$$-NHSO_2NH-,\ \text{-(alkylene)-}\overset{O}{\overset{\|}{C}}NH-,\ \text{-(arylene)-}SO_2NH-,$$

$$\text{-(arylene)-}NH\overset{O}{\overset{\|}{C}}NH-\ \text{and}\ \text{-(arylene)-}\overset{O}{\overset{\|}{C}}NH-.$$

The counter ion for charge balance represented by Y includes a bromide ion, a chloride ion, an iodide ion, a p-toluenesulfonate ion, an ethylsulfonate ion, a perchlorate ion, a trifluoromethanesulfonate ion, a thiocyanate ion, a $BF_4^-$ion and a $PF_6^-$ion.

Of the compounds represented by the formula (N-1), those having a group capable of accelerating adsorption by silver halide grains are preferred. Particularly, those having a thioamido group, an azole group or a heterocyclic mercapto group, as the adsorption accelerating group represented by $X^1$ are more preferred.

Examples of these compounds and synthetic methods therefor are described, for example, in Japanese Patent Application No. 62-17984 and the patents and literature cited therein.

Specific examples of the compounds represented by the formula (N-1) are set forth below, but the present invention is not to be construed as being limited to these compounds.

(N-I-1)
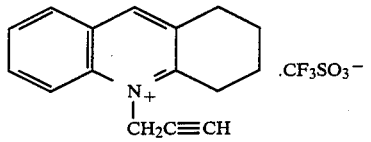
(N-I-2)
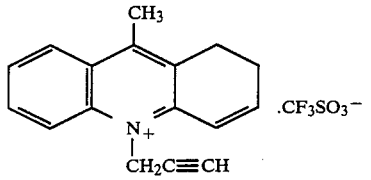
(N-I-3)
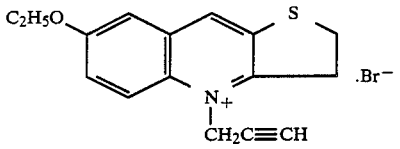
(N-I-4)
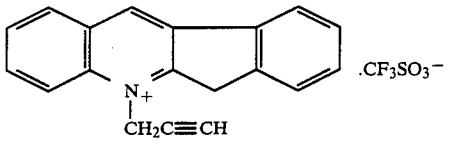
(N-I-5)
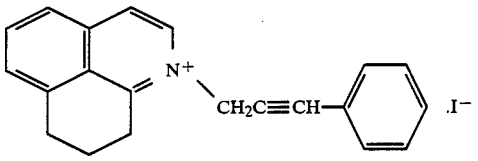
(N-I-6)
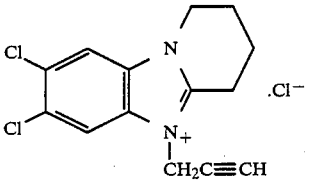
(N-I-7)
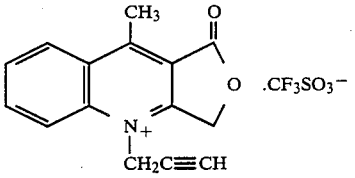
(N-I-8)
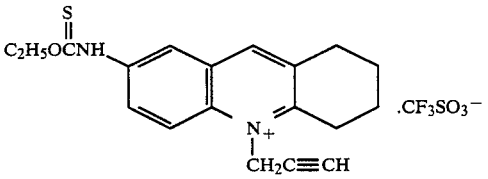
(N-I-9)
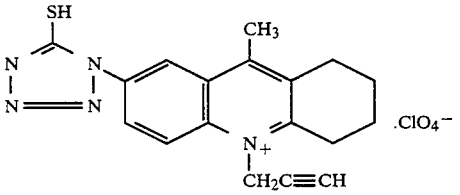

-continued
(N-I-10)
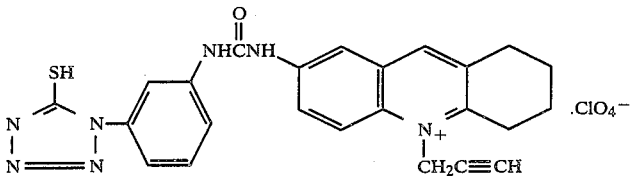
(N-I-11)
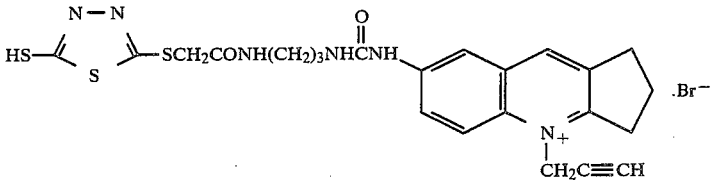
(N-I-12)
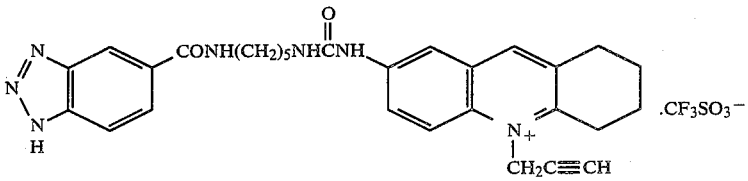
(N-I-13)
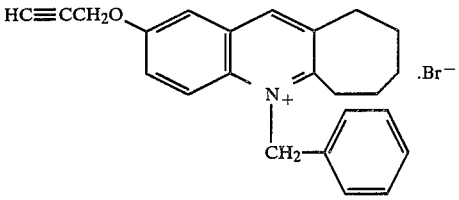
(N-I-14)
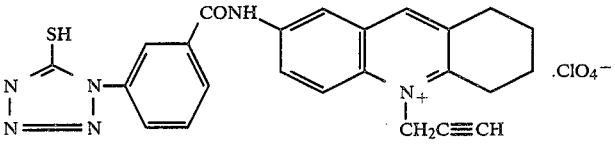
(N-I-15)
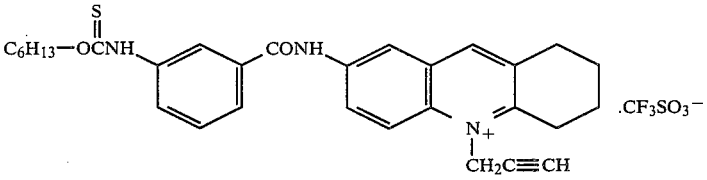
(N-I-16)
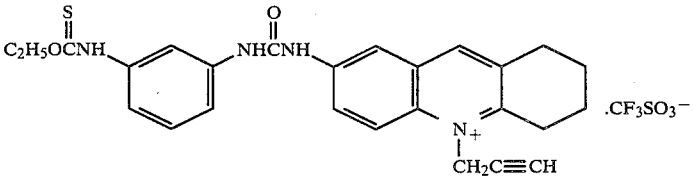
(N-I-17)
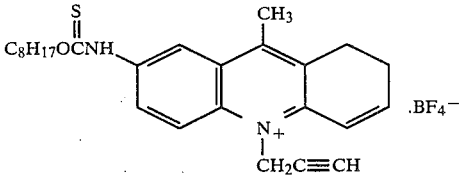

-continued (N-I-18)

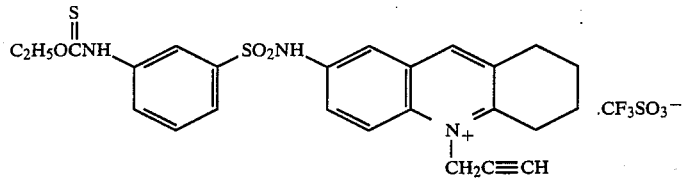

(N-I-19)

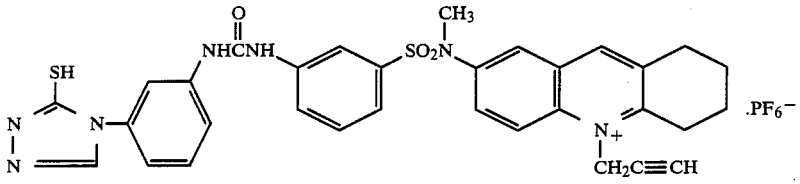

(N-I-20)

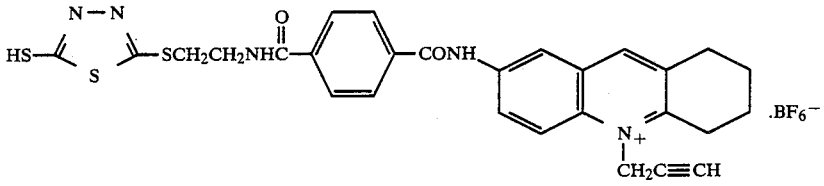

(N-I-21)

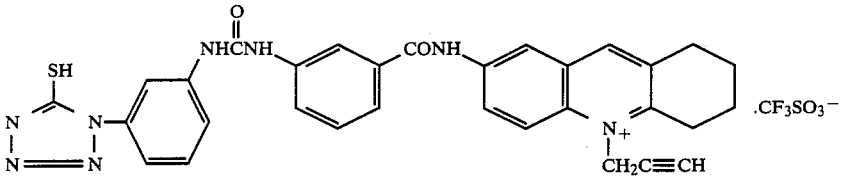

(N-I-22)

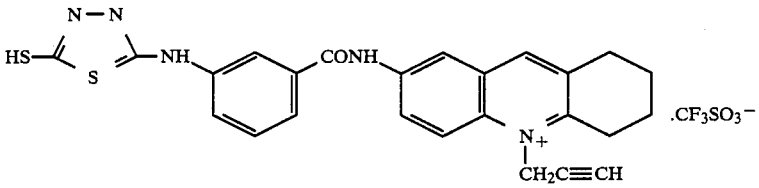

(N-I-23)

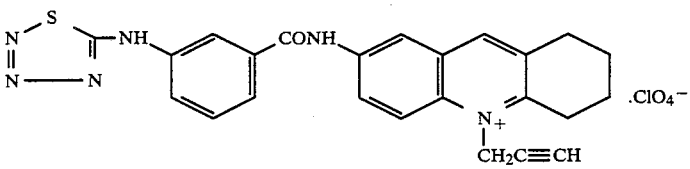

(N-I-24)

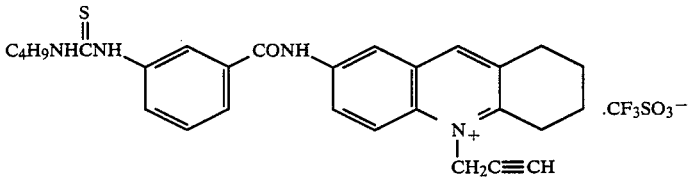

(N-I-25)

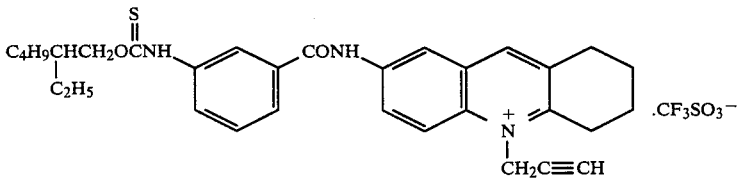

In the case of incorporating the compound represented by the formula (N-1) described above in a photographic light-sensitive material according to the present invention, it suffices to add the compound to a hydrophilic colloidal solution as a solution in a water-miscible organic solvent such as an alcohol (e.g., methanol, ethanol), an ester (e.g., ethyl acetate) or a ketone (e.g., acetone), or, where the compound is water-soluble, as an aqueous solution.

In adding the compound to a photographic emulsion, the addition may be made at any stage from the initiation of chemical ripening to the stage before coating, with the stage after completion of chemical ripening being preferable.

In the present invention, the nucleating agent represented by the formula (N-1) may be incorporated in a hydrophilic colloidal layer adjacent to a silver halide emulsion layer, but is preferably incorporated in a silver halide emulsion. The amount of the agent to be added can vary over a wide range since it varies depending upon the properties of silver halide emulsion which is actually used, the chemical structure of the nucleating agent, and the developing conditions. However, the nucleating agent is usefully added in an amount of from about $1\times10^{-8}$ mol to about $1\times10^{-2}$ mol per mol of silver in the silver halide emulsion, preferably from about $1\times10^{-7}$ mol to about $1\times10^{-3}$ mol per mol of silver in the silver halide emulsion.

In order to form direct positive color images in the present invention, various color couplers can be employed. Useful color couplers are compounds that can undergo a coupling reaction with an oxidation product of an aromatic primary amine type color developing agent to produce or release a dye substantially nondiffusible and that themselves are preferably substantially nondiffusible. Typical examples of useful color couplers include naphtholic or phenolic compounds, pyrazolone or pyrazoloazole compounds and open chain or heterocyclic ketomethylene compounds. Specific examples of these cyan, magenta and yellow couplers which can be used in the present invention include compounds described in *Research Disclosure,* No. 17643 (December, 1978), page 25, Section VII-D; ibid., No. 18717 (November, 1979); JP-A-62-215272; and compounds described in the patents cited therein.

Among others, typical yellow couplers that can be used in the present invention include yellow 2- equivalent couplers of oxygen atom releasing or nitrogen atom releasing type. Particularly, α-pivaloylacetanilide type couplers are excellent in fastness, in particular light fastness, of the dyes formed therefrom, while α-benzoylacetanilide type couplers are preferred because a high color density can be obtained.

5-Pyrazolone type magenta couplers preferably used in the present invention are 5-pyrazolone type couplers (particularly, sulfur atom releasing type 2-equivalent couplers) substituted at the 3-position with an arylamino group or an acylamino group.

Pyrazoloazole type couplers are further preferred. Among them, pyrazolo[5,1-c][1,2,4]triazoles described in U.S. Pat. No. 3,725,067 are preferred, imidazo[1,2-b]pyrazoles described in U.S. Pat. No. 4,500,630 are most preferred in view of the fastness to light and the low yellow subsidiary absorption of the dye formed therefrom, and pyrazolo[1,5-b][1,2,4]triazoles described in U.S. Pat. No. 4,540,654 are particularly preferred.

Cyan couplers preferably used in the present invention include naphtholic and phenolic couplers described in U.S. Pat. Nos. 2,474,293 and 4,052,212, and phenolic cyan couplers having an alkyl group containing two or more carbon atoms at the meta-position of the phenol nucleus described in U.S. Pat. No. 3,772,002. In addition, 2,5-diacylamino-substituted phenolic couplers are also preferred in view of fastness of the color image formed therefrom.

Colored couplers for correcting undesired absorption in the short wavelength range of produced dyes; couplers capable of forming dyes with appropriate diffusibility; non-color-forming couplers; DIR couplers that can release a development inhibitor as a result of the coupling reaction; and polymerized couplers can also be used.

Generally, the amount of a color coupler used is in the range of from about 0.001 to about 1 mol per mol of a light-sensitive silver halide, and preferably in the case of a yellow coupler the amount is from about 0.01 to about 0.5 mol per mol of a light-sensitive silver halide, in the case of a magenta coupler the amount is from about 0.03 to about 0.5 mol per mol of a light-sensitive silver halide, and in the case of a cyan coupler the amount is from about 0.002 to about 0.5 mol per mol of a light-sensitive silver halide.

In the present invention, a color formation reinforcing agent can be employed for the purpose of increasing the color forming property of the coupler. Representative examples of such compounds are described in JP-A-62-215272, pages 374 to 391.

The couplers used in the present invention are dissolved in an organic solvent having a high boiling point and/or an organic solvent having a low boiling point, the solution is finely emulsified or dispersed in an aqueous solution of gelatin or other hydrophilic colloids by means of high speed agitation using a homogenizer, etc., a mechanical procedure using a colloid mill, etc., or a technique using ultrasonic waves, and then the emulsified dispersion is mixed with a photographic emulsion, followed by coating to form a layer. In this case, although it is not always necessary to employ an organic solvent having a high boiling point, it is preferred to use such an organic solvent having a high boiling point, specific examples of which include the compounds described in JP-A-62-215272, pages 440 to 467.

The couplers used in the present invention can be dispersed in a hydrophilic colloid according to the methods described in JP-A-62-215272, pages 468 to 475.

The photographic light-sensitive material in accordance with the present invention may contain, as a color fog preventing agent or color mixing preventing agent, hydroquinone derivatives, aminophenol derivatives, amines, gallic acid derivatives, catechol derivatives, ascorbic acid derivatives, non-color-forming couplers, sulfonamidophenol derivatives, etc. Typical examples of color fog preventing agents and color mixing preventing agents are described in JP-A-62-215272, pages 600 to 630.

In the photographic light-sensitive material of the present invention, various color fading preventing agents can be used. Typical organic color fading preventing agents include hydroquinones, 6-hydroxychromans, 5-hydroxycoumarans, spirochromans, p-alkoxyphenols, hindered phenols including bisphenols, gallic acid derivatives, methylenedioxybenzenes, aminophenols, hindered amines and ether or ester derivatives obtained by the silylation or alkylation of the phenolic hydroxyl group of these compounds. Further, metal complexes such as (bissalicylalkoxymato)nickel complex and (bis-N,N-dialkyldithiocarbamato)nickel complexes can be used.

For the purpose of preventing yellow dye images from being deteriorated by heat, humidity and light, compounds having both a hindered amine and a hindered phenol in the molecule described in U.S. Pat. No. 4,268,593 give good results. For the purpose of preventing magenta dye images from being deteriorated, particularly by heat, spiroindans described in JP-A-56-159644 and chromans substituted with hydroquinone diethers or monoethers described in JP-A-55-89835 give good results.

Typical examples of these color fading preventing agents are described in JP-A-62-215272, pages 401 to 440. The desired aim can be attained when these compounds are added to light-sensitive layers generally in amounts of 5 to 100 wt% based on the respective color couplers by coemulsifying them with the couplers.

For the purpose of preventing cyan dye images from being deteriorated by heat and, particularly, light, it is effective to introduce an ultraviolet light absorbing agent into both layers adjacent to a cyan color forming layer. An ultraviolet light absorbing agent can also be added to a hydrophilic colloid layer such as a protective layer. Typical examples of such compounds are described in JP-A-62-215272, pages 391 to 400.

As binders or protective colloids which can be used in emulsion layers and intermediate layers of the photographic light-sensitive material of the present invention, it is advantageous to use gelatin, but other hydrophilic colloids than gelatin can also be used.

The photographic light-sensitive material of the present invention can contain dyes for preventing irradiation or halation, ultraviolet light absorbing agents, plasticizers, fluorescent brightening agents, matting agents, aerial fog preventing agents, coating aids, hardening agents, antistatic agents, lubricants, etc. Typical examples of these additives are described in *Research Disclosure,* No. 17643, Sections VIII to XIII (December, 1978), pages 25 to 27, and ibid., No. 18716 (November, 1979), pages 647 to 651.

The present invention can be applied to multilayer multicolor photographic materials having at least two layers having different spectral sensitivities on a support. Generally, a multilayer natural color photographic material has at least one red-sensitive emulsion layer, at least one green-sensitive emulsion layer and at least one blue-sensitive emulsion layer on a support. The order of these layers is appropriately selected as desired. In a preferred order of the layers, a red-sensitive emulsion layer, a green-sensitive emulsion layer and a blue-sensitive emulsion layer are coated in that order on a support or a green-sensitive emulsion layer, a red-sensitive emulsion layer and a blue-sensitive emulsion layer are coated in that order on a support. Each of these emulsion layers may consist of two or more emulsion layers different in sensitivity, or may consist of two or more emulsion layers having the same sensitivity with a light-insensitive layer between them. Generally, the red-sensitive emulsion layer contains a cyan forming coupler, the green-sensitive emulsion layer contains a magenta forming coupler and the blue-sensitive emulsion layer contains a yellow forming coupler, but in some cases the combination can be changed.

For the purpose of increasing maximum image density, of reducing minimum image density, of improving preservability of the photographic light-sensitive material, and of quickening the development, the following compounds can be added: hydroquinones (e.g., compounds described in U.S. Pat. Nos. 3,227,552 and 4,279,987); chromans (e.g., compounds described in U.S. Pat. No. 4,268,621, JP-A-54-10303and *Research Disclosure,* No. 18264 (June, 1979), pages 333 and 334); quinones (e.g., compounds described in *Research Disclosure,* No. 21206 (December, 1981), pages 433 and 434); amines (e.g., compounds described in U.S. Pat. No. 4,150,993 and JP-A-58-174757; oxidizing agents (e.g., compounds described in JP-A-60-260039 and *Research Disclosure,* No. 16936 (May, 1978), pages 10 and 11); catechols (e.g., compounds described in JP-A-55-21013 and JP-A-55-65944); compounds capable of releasing a nucleating agent at the time of development (e.g., compounds described in JP-A-60-107029); thioureas (e.g., compounds described in JP-A-60-95533); and spirobisindans (e.g., compounds described in JP-A-55-65944).

It is preferable that the photographic light-sensitive material according to the invention is provided with suitable auxiliary layers such as a protective layer, an intermediate layer, a filter layer, an anti-halation layer, a backing layer and a white light reflective layer, in addition to the silver halide emulsion layers.

In the photographic light-sensitive materials of the present invention, the photographic emulsion layers and other layers are applied on supports described in *Research Disclosure,* No. 17643, Section XVII (December, 1978), page 28, European Patent No. 0,182,253, and JP-A-61-97655. The coating methods described in *Research Disclosure,* No. 17643, Section XV, pages 28 and 29 can be employed.

The present invention may be applied to various types of color photographic light-sensitive materials.

For instance, color reversal films for slides and television, color reversal papers, and instant color films are typical examples. In addition, the present invention may be applied to color hard copies for preserving images of full color copies or CRT. The present invention is also applicable to black-and-white photographic light-sensitive materials utilizing mixing of three color couplers, described in *Research Disclosure,* No. 17123 (July, 1978).

Furthermore, the present invention can be applied to black-and-white photographic light-sensitive materials. Examples of the black-and-white (B/W) photographic light-sensitive materials to which can be applied the present invention include B/W direct positive photographic light-sensitive materials (for example photographic materials for X-ray, for duplication, for micrography, for photocomposing, and for printing) described, for example, in JP-A-59-208540 and JP-A-60-260039.

For developing the B/W photographic light-sensitive materials in the present invention, various known developing agents can be used alone or in combination. Examples of such developing agents include polyhydroxybenzenes such as hydroquinone, 2-chlorohydroquinone, 2-methylhydroquinone, catechol, and pyrogallol; aminophenols such as p-aminophenol, N-methyl-p-aminophenol, and 2,4-diaminophenol; 3-pyrazolidones such as 1-phenyl-4,4'-dimethyl-3-pyrazolidone and 1-phenyl-4-methyl-4-hydroxymethyl-3-pyrazolidone; and ascorbic acids. Also, the developers described in JP-A-58-55928 can be used. Detailed description of specific examples and the way of using developing agents, preservatives, buffers and developing processes for B/W photographic light-sensitive materials are found in *Research Disclosure,* No. 17643 (December, 1978), XIX to XXI.

In the present invention, in order to accelerate the function of the nucleating agent represented by the formula (N-1) described above, a nucleation accelerating agent described below ca be employed.

Nucleation accelerating agents which can be used include tetraazaindenes, triazaindenes and pentaazaindenes having at least one mercapto group that may be optionally substituted with an alkali metal atom or an ammonium group, and compounds described in JP-A-63-106656.

Specific examples of the nucleation accelerating agents used are illustrated below, but the present invention is not to be construed as being limited to these compounds.

(A- 1): 3-Mercapto-1,2,4-triazolo[4,5-a]pyridine
(A- 2): 3-Mercapto-1,2,4-triazolo[4,5-a]pyrimidine
(A- 3): 5-Mercapto-1,2,4-triazolo[l,5-a]pyrimidine
(A- 4): 7-(2-Dimethylaminoethyl)-5-mercapto-1,2,4-triazolo[1,5-a]pyrimidine
(A- 5): 3-Mercapto-7-methyl-1,2,4-triazolo[4,5-a]-pyrimidine
(A- 6) 3,6-Dimercapto-1,2,4-triazolo[4,5-b]pyridazine
(A- 7): 2-Mercapto-5-methylthio-1,3,4-thiadiazole
(A- 8): 3-Mercapto-4-methyl-1,2,4-triazole
(A- 9): 2-(3-Dimethylaminopropylthio)-5-mercapto-1,3,4-thiadiazole hydrochloride
(A-10): 2-(2-Morpholinoethylthio)-5-mercapto-1,3,4-thiadiazole hydrochloride
(A-11): 2-Mercapto-5-methylthiomethylthio-1,3,4-thiadiazole sodium salt
(A-12): 4-(2-Morpholinoethyl)-3-mercapto-1,2,4-triazole
(A-13): 2-[2-(2-Dimethylaminoethylthio)ethylthio]-5-mercapto-1,3,4-thiadiazole hydrochloride
(A-14): 2-(6-Dimethylaminohexylthio)-5-mercapto-1,3,4-thiadiazole hydrochloride
(A-15): 2-{3-[2-Methyl-1-(1,4,5,6-tetrahydropyrimidinyl)]propylthio}-5-mercapto-1,3,4 -thiadiazole hydrochloride Although the nucleation accelerating agent can be incorporated into the photographic light-sensitive material or a processing solution, it is preferred to incorporate the nucleation accelerating agent into the photographic light-sensitive material, particularly into an internal latent image type silver halide emulsion layer or other hydrophilic colloid layers such as an intermediate layer, and a protective layer. It is particularly preferred that the nucleation accelerating agent is added to a silver halide emulsion or a layer adjacent thereto.

The color developing solution which can be used in development processing of the photographic light-sensitive material according to the present invention is an alkaline aqueous solution containing preferably an aromatic primary amine type color developing agent as a main component. As the color developing agent, while an aminophenol type compound is useful, a p-phenylenediamine type compound is preferably employed. Typical examples of the p-phenylenediamine type compounds include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline, or sulfate, hydrochloride or p-toluenesulfonate thereof.

Two or more kinds of color developing agents may be employed in a combination thereof, depending on the purpose.

The pH of the color developing solution used is ordinarily from 9 to 12, preferably from 9.5 to 11.5.

After color development, the photographic emulsion layers are usually subjected to a bleach processing. The bleach processing can be performed simultaneously with a fix processing (bleach-fix processing), or it can be performed independently from the fix processing. Further, for the purpose of performing a rapid processing, a processing method wherein after a bleach processing a bleach-fix processing is conducted may be employed. Moreover, it may be appropriately practiced depending on the purpose to process using a continuous two tank bleach-fixing bath, to carry out fix processing before bleach-fix processing, or to conduct bleach processing after bleach-fix processing.

Examples of bleaching agents which can be employed in the bleach processing or bleach-fix processing include compounds of a multivalent metal such as iron(III), cobalt(III), chromium(VI), and copper(II); peracids; quinones; and nitro compounds. Representative examples of the bleaching agents include ferricyanides; dichloromates; organic complex salts of iron(III) or cobalt(III), for example, complex salts of aminopolycarboxylic acids (such as ethylenediaminetetraacetic acid, diethylenetriaminepentaacetic acid, cyclohexanediaminetetraacetic acid, methyliminodiacetic acid, 1,3-diaminopropanetetraacetic acid, and glycol ether diaminetetraacetic acid), or complex salts of organic acids (such as citric acid, tartaric acid, and malic acid); persulfates; bromates; permanganates; and nitrobenzenes. Of these compounds, iron(III) complex salts of aminopolycarboxylic acids represented by iron(III) complex salt of ethylenediaminetetraacetic acid and persulfates are preferred in view of rapid processing and less environmental pollution. Furthermore, iron(III) complex salts of aminopolycarboxylic acids are particularly useful in both bleaching solutions and bleach-fixing solutions.

The pH of the bleaching solution or bleach-fixing solution containing an iron(III) complex salt of aminopolycarboxylic acid is usually in a range from 5.5 to 8. For the purpose of rapid processing, it is possible to process at pH lower than the above-described range.

As fixing agents which can be employed in the fixing solution or bleach-fixing solution, thiosulfates, thiocyanate, thioether compounds, thioureas, a large amount of iodide, etc., are exemplified. Of these compounds, thiosulfates are generally employed. Particularly, ammonium thiosulfate is most widely employed. It is preferred to use sulfites, bisulfites or carbonylbisulfite adducts as preservatives in the bleach-fixing solution.

After a desilvering step, the silver halide color photographic material according to the present invention is generally subjected to a water washing step and/or a stabilizing step.

An amount of water required for the water washing step may be set in a wide range depending on characteristics of photographic light-sensitive materials (due to elements used therein, for example, couplers, etc.), uses thereof, temperature of washing water, a number of water washing tanks (stages), a replenishment system such as countercurrent or orderly current, or other various conditions. The relationship between the number of water washing tanks and the amount of water in a multistage countercurrent system can be determined based on the method described in *Journal of the Society of Motion Picture and Television Engineers,* Vol. 64, pages 248 to 253 (May, 1955).

According to the multistage countercurrent system described in the above literature, the amount of water for washing can be significantly reduced. However, increase in staying time of water in the tank causes propagation of bacteria and some problems such as adhesion of suspended matters formed on the photographic materials occur. In the method of processing the silver halide color photographic material according to the present invention, a method for reducing amounts of calcium ions and magnesium ions described in JP-A-62-288838 can be particularly effectively employed in order to solve such problems. Further, sterilizers, for example, isothiazolone compounds described in JP-A-57-8542, thiabendazoles, chlorine type sterilizers such as sodium chloroisocyanurate, benzotriazoles, and sterilizers described in Hiroshi Horiguchi, *Bokin-Bobai no Kacaku, Biseibutsu no Mekkin-, Sakkin-, Bobai-Gijutsu,* edited by Erseigijutsu Kai, *Bokin-Bobaizai Jiten,* edited by Nippon Bokin-Bobai Gakkai can be employed.

The pH of the washing water used in the processing of the photographic light-sensitive materials according to the present invention is usually from 4 to 9, preferably from 5 to 8. The temperature of the washing water and the time for the water washing step can be variously set depending on characteristics or uses of photographic light-sensitive materials, etc. However, it is general to select a range of from 15° C. to 45° C. and a period of from 20 seconds to 10 minutes and preferably a range of from 25° C. to 40° C. and a period of from 30 seconds to 5 minutes.

The photographic light-sensitive material according to the present invention can also be directly processed with a stabilizing solution in place of the above-described water washing step. In such a stabilizing process, any of known methods described, for example, in JP-A-57-8543, JP-A-58-14834 and JP-A-60-220345 can be employed. To such a stabilizing bath, various chelating agents and antimolds may also be added.

Overflow solutions resulting from replenishment for the above-described washing water and/or stabilizing solution may be reused in other steps such as a desilvering step.

For the purpose of simplification and acceleration of processing, a color developing agent may be incorporated into the silver halide color photographic material according to the present invention. In order to incorporate the color developing agent, it is preferred to employ various precursors of color developing agents. Suitable examples of the precursors of developing agents include indoaniline type compounds described in U.S. Pat. No. 3,342,597, Schiff's base type compounds described in U.S. Pat. No. 3,342,599, *Research Disclosure,* No. 14850 and ibid., No. 15159, aldol compounds described in *Research Disclosure,* No. 13924, metal salt complexes described in U.S. Pat. No. 3,719,492, and urethane type compounds described in JP-A-53-135628.

Further, the silver halide color photographic material according to the present invention may contain, if desired, various 1-phenyl-3-pyrazolidones for the purpose of accelerating color development. Typical examples of the compounds include those described, for example, in JP-A-56-64339, JP-A-57-144547 and JP-A-58-115438.

In the present invention, various kinds of processing solutions can be employed in a temperature range from 10° C. to 50° C. Although a standard temperature is from 33° C. to 38° C., it is possible to carry out the processing at higher temperatures in order to accelerate the processing whereby the processing time is shortened, or at lower temperatures in order to achieve improvement in image quality and to maintain stability of the processing solutions.

Further, for the purpose of saving the amount of silver employed in the color photographic light-sensitive material, the photographic processing may be conducted utilizing color intensification using cobalt or hydrogen peroxide described in West German Patent No. 2,226,770 or U.S. Pat. No. 3,674,499.

It is preferred that the amount of the replenisher is small in each processing step. Preferably the amount of the replenisher is from 0.1 to 50 times, more preferably from 3 to 30 times the amount of the solution carried over from the preceding bath per unit area of the photographic light-sensitive material.

The present invention is now illustrated in greater detail with reference to the following examples, but the present invention is not to be construed as being limited thereto. Unless otherwise indicated, all parts, percents and ratios are by weight.

EXAMPLE 1

The following First Layer to Fourteenth Layer were coated on the front side of a paper support (having a thickness of 100 μm), both surfaces of which were laminated with polyethylene, and the following Fifteenth Layer to Sixteenth Layer were coated on the back side of the paper support to prepare a color photographic light-sensitive material. The polyethylene laminated on the First Layer side of the support contained titanium dioxide as a white pigment and a small amount of ultramarine as a bluish dye.

Construction of Layers

The composition of each layer is shown below. The coating amounts of the components are described in the unit of g/m$^2$. With respect to silver halide, the coating amount is indicated in terms of a silver coating amount. The emulsion used in each layer was prepared according to the method for preparation of Emulsions EM-A, EM-1, EM-2, and EM-3 described below. The emulsion used in the Fourteenth Layer is a Lippmann emulsion not being chemically sensitized on the surfaces of grains.

| | |
|---|---|
| First Layer: Antihalation Layer | |
| Black colloidal silver | 0.10 |
| Gelatin | 1.30 |
| Second Layer: Intermediate Layer | |
| Gelatin | 0.70 |
| Third Layer: Low-Sensitive Red-Sensitive Layer | |
| Silver bromide emulsion spectrally sensitized with red-sensitizing dyes (ExS-1, ExS-2, ExS-3) (average grain size: 0.3 μm, size distribution (coefficient of variation): 8%, octahedral) | 0.06 |
| Silver chlorobromide emulsion spectrally sensitized with red-sensitizing dyes (ExS-1, ExS-2, ExS-3) (silver chloride: 5 mol %, average grain size: 0.45 μm, size distribution: 10%, octahedral) | 0.10 |
| Gelatin | 1.00 |
| Cyan coupler (ExC-1) | 0.11 |
| Cyan coupler (ExC-2) | 0.10 |
| Color fading preventing agent (Cpd-2, Cpd-3, Cpd-4, Cpd-13, mixing ratio: 1/1/1/1) | 0.12 |
| Coupler dispersing medium (Cpd-5) | 0.03 |
| Coupler solvent (Solv-7, Solv-2, Solv-3, mixing ratio: 1/1/1) | 0.06 |
| Fourth Layer: High-Sensitive Red-Sensitive Layer | |
| Silver bromide emulsion spectrally sensitized with red-sensitizing dyes (ExS-1, ExS-2, ExS-3) (average grain size: 0.60 μm, size distribution: 15%, octahedral) | 0.14 |
| Gelatin | 1.00 |
| Cyan coupler (ExC-1) | 0.15 |
| Cyan coupler (ExC-2) | 0.15 |
| Color fading preventing agent (Cpd-2, Cpd-3, Cpd-4, Cpd-13, mixing ratio: 1/1/1/1) | 0.15 |
| Coupler dispersing medium (Cpd-5) | 0.03 |
| Coupler solvent (Solv-7, Solv-2, Solv-3, mixing ratio: 1/1/1) | 0.10 |
| Fifth Layer: Intermediate Layer | |
| Gelatin | 1.00 |
| Color mixing preventing agent (Cpd-7) | 0.08 |
| Color mixing preventing agent solvent | 0.16 |

-continued

| | |
|---|---|
| (Solv-4, Solv-5, mixing ratio: 1/1) | |
| Polymer latex (Cpd-8) | 0.10 |
| Sixth Layer: Low-Sensitive Green-Sensitive Layer | |
| Silver bromide emulsion spectrally sensitized with green-sensitizing dye (ExS-3) (average grain size: 0.25 μm, size distribution: 8%, octahedral) | 0.04 |
| Silver bromide emulsion spectrally sensitized with green-sensitizing dyes (ExS-3, ExS-4) (average grain size: 0.45 μm, size distribution: 11%, octahedral) | 0.06 |
| Gelatin | 0.80 |
| Magenta coupler (ExM-1, ExM-2, mixing ratio: 1/1) | 0.11 |
| Color fading preventing agent (Cpd-9) | 0.10 |
| Stain preventing agent (Cpd-10, Cpd-22, mixing ratio: 1/1) | 0.014 |
| Stain preventing agent (Cpd-23) | 0.001 |
| Stain preventing agent (Cpd-12) | 0.01 |
| Coupler dispersing medium (Cpd-5) | 0.05 |
| Coupler solvent (Solv-4, Solv-6, mixing ratio: 1/1) | 0.15 |
| Seventh Layer: High-Sensitive Green-Sensitive Layer | |
| Silver bromide emulsion spectrally sensitized with green-sensitizing dyes (ExS-3, ExS-4) (average grain size: 0.8 μm, size distribution: 16%, octahedral) | 0.10 |
| Gelatin | 0.80 |
| Magenta coupler (ExM-1, ExM-2, mixing ratio: 1/1) | 0.11 |
| Color fading preventing agent (Cpd-9) | 0.10 |
| Stain preventing agent (Cpd-10, Cpd-22, mixing ratio: 1/1) | 0.013 |
| Stain preventing agent (Cpd-23) | 0.001 |
| Stain preventing agent (Cpd-12) | 0.01 |
| Coupler dispersing medium (Cpd-5) | 0.05 |
| Coupler solvent (Solv-4, Solv-6, mixing ratio: 1/1) | 0.15 |
| Eighth Layer: Intermediate Layer | |
| The same as Fifth Layer | |
| Ninth Layer: Yellow Filter Layer | |
| Yellow colloidal silver | 0.20 |
| Gelatin | 1.00 |
| Color mixing preventing agent (Cpd-7) | 0.06 |
| Color mixing preventing agent solvent (Solv-4, Solv-5, mixing ratio: 1/1) | 0.15 |
| Polymer latex (Cpd-8) | 0.10 |
| Tenth Layer: Intermediate Layer | |
| The same as Fifth Layer | |
| Eleventh Layer: Low-Sensitive Blue-Sensitive Layer | |
| Silver bromide emulsion spectrally sensitized with blue-sensitizing dyes (ExS-5, ExS-6) (average grain size: 0.45 μm, size distribution: 8%, octahedral) | 0.07 |
| Silver bromide emulsion spectrally sensitized with blue-sensitizing dyes (ExS-5, ExS-6) (average grain size: 0.60 μm, size distribution: 14%, octahedral) | 0.10 |
| Gelatin | 0.50 |
| Yellow coupler (ExY-1) | 0.22 |
| Stain preventing agent (Cpd-11) | 0.001 |
| Color fading preventing agent (Cpd-6) | 0.10 |
| Coupler dispersing medium (Cpd-5) | 0.05 |
| Coupler solvent (Solv-2) | 0.05 |
| Twelfth Layer: High-Sensitive Blue-Sensitive Layer | |
| Silver bromide emulsion spectrally sensitized with blue-sensitizing dyes (ExS-5, ExS-6) (average grain size: 1.2 μm, size distribution: 21%, octahedral) | 0.25 |
| Gelatin | 1.00 |
| Yellow coupler (ExY-1) | 0.41 |
| Stain preventing agent (Cpd-11) | 0.002 |
| Color fading preventing agent (Cpd-6) | 0.10 |
| Coupler dispersing medium (Cpd-5) | 0.05 |
| Coupler solvent (Solv-2) | 0.10 |
| Thirteenth Layer: Ultraviolet Light Absorbing Layer | |
| Gelatin | 1.50 |
| Ultraviolet light absorbing agent (Cpd-1, (Cpd-3, Cpd-13, mixing ratio: 1/1/1) | 1.00 |

-continued

| | |
|---|---|
| Color mixing preventing agent (Cpd-6, Cpd-14, mixing ratio: 1/1) | 0.06 |
| Dispersing medium (Cpd-5) | 0.05 |
| Ultraviolet light absorbing agent solvent (Solv-1, Solv-2, mixing ratio: 1/1) | 0.15 |
| Irradiation preventing dye (Cpd-15, Cpd-16, mixing ratio: 1/1) | 0.02 |
| Irradiation preventing dye (Cpd-17, Cpd-18, mixing ratio: 1/1) | 0.02 |
| Fourteenth Layer: Protective Layer | |
| Silver chlorobromide fine particles (silver chloride: 97 mol %, average grain size: 0.2 μm) | 0.05 |
| Acryl-modified copolymer of polyvinyl alcohol (degree of modification: 17%) | 0.02 |
| Polymethyl methacrylate particles (average particle size: 2.4 μm) and silicon oxide (average particle size: 5 μm, mixing ratio: 1/1) | 0.05 |
| Gelatin | 1.50 |
| Gelatin hardener (H-1) | 0.17 |
| Fifteenth Layer: Back Layer | |
| Gelatin | 2.50 |
| Sixteenth Layer: Back Protective Layer | |
| Polymethyl methacrylate particles (average particle size: 2.4 μm) and silicon oxide (average particle size: 5 μm, mixing ratio: 1/1) | 0.05 |
| Gelatin | 2.00 |
| Gelatin hardener (H-1) | 0.11 |

Preparation of Emulsion EM-A:

An aqueous solution of potassium bromide and an aqueous solution of silver nitrate were added simultaneously to an aqueous gelatin solution at 75° C over 15 minutes while vigorously stirring to obtain an octahedral silver bromide emulsion having an average grain diameter of 0.40 μm. 0.3 g of 3,4-dimethyl-1,3-thiazoline-2-thione, 6 mg of sodium thiosulfate and 7 mg of chloroauric acid (tetrahydrate) were added to the emulsion per mol of silver in order and the emulsion was heated to 75° C. for 80 minutes to be chemically sensitized. The thus-prepared silver bromide grains were used as cores and were further grown under the same precipitation conditions as above to obtain finally a monodispersed octahedral core/shell type silver bromide emulsion having an average grain diameter of 0.7 μm. The coefficient of variation of the grain size was about 10%.

1.5 mg of sodium thiosulfate and 1.5 mg of chloroauric acid (tetrahydrate) were added to the emulsion per mol of silver, and the emulsion was heated to 69° C. for 60 minutes to be chemically sensitized thus an internal latent image type silver halide emulsion was obtained.

In each light-sensitive layer, the nucleating agent described in Table 2 below was used and Cpd-24, as a nucleation accelerating agent, in an amount of $1\times10^{-2}$% by weight per the coating amount of silver halide was employed.

To each layer, as emulsifying dispersing aids, Alkanol XC (manufactured by Du Pont) and sodium alkylbenzenesulfonate, and as coating aids, succinic acid ester and Magefac F-120 (manufactured by Dai Nippon Ink and Chemical Co., Ltd.) were added. Furthermore, to the layers containing silver halide or colloidal silver, stabilizers (Cpd-19, 20, 21) were added. The thus-obtained photographic light-sensitive material was designated Comparative Sample-A.

The compounds used in this sample are illustrated below.

ExS-1
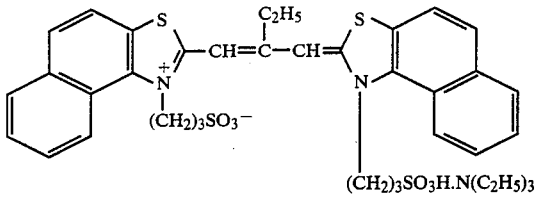
ExS-2
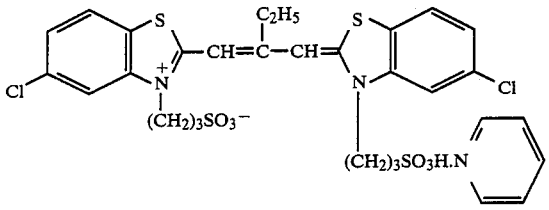
ExS-3
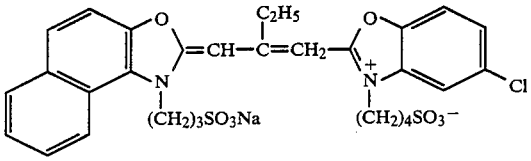
ExS-4
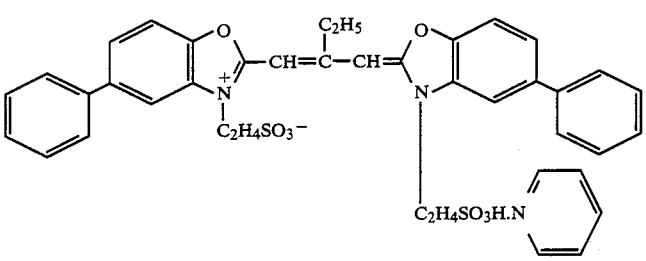
ExS-5
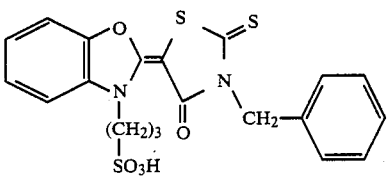
ExS-6
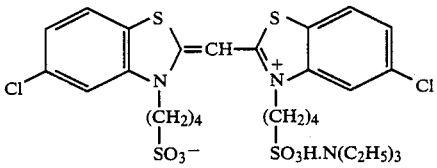
Cpd-1
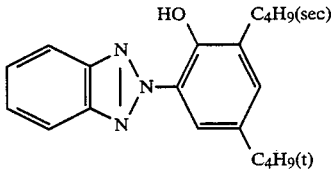
Cpd-2
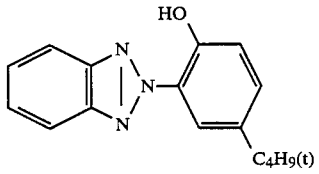

-continued
Cpd-3
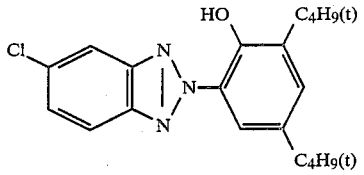
Cpd-4
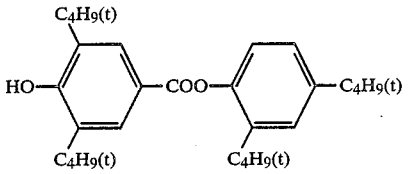
Cpd-5
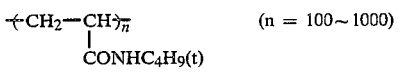
Cpd-6
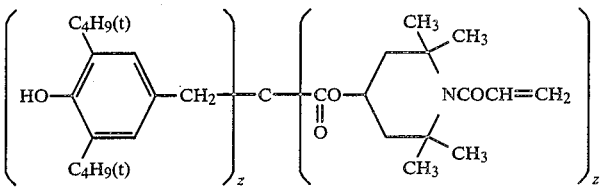
Cpd-7
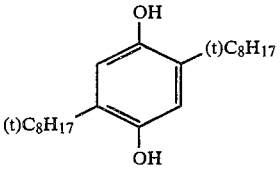
Polyetheracrylate
Cpd-8
Cpd-9
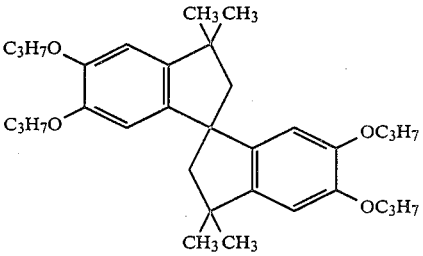
Cpd-10
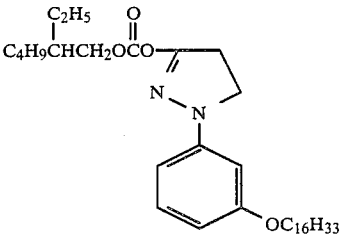
Cpd-11
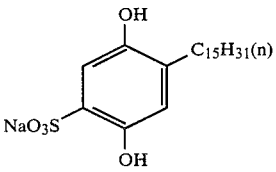

-continued
Cpd-12
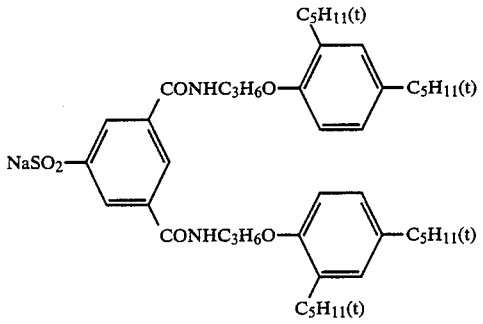
Cpd-13
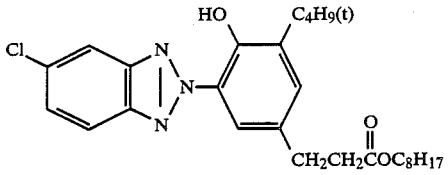
Cpd-14
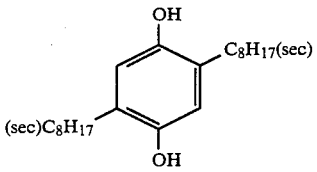
Cpd-15
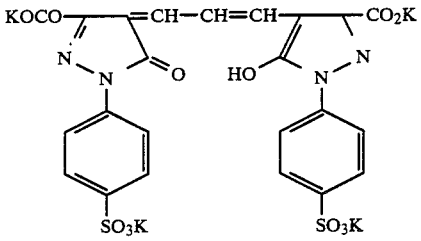
Cpd-16
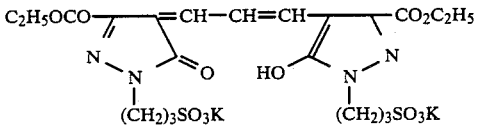
Cpd-17
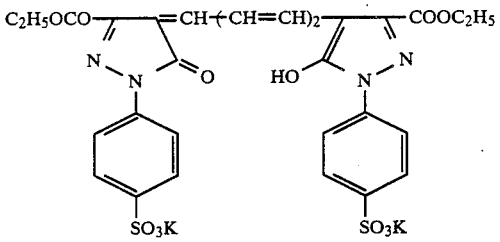
Cpd-18
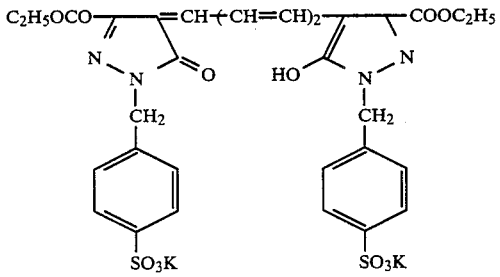

-continued
Cpd-19
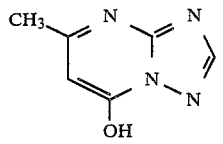
Cpd-20
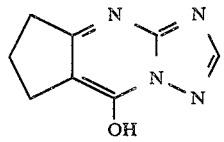
Cpd-21
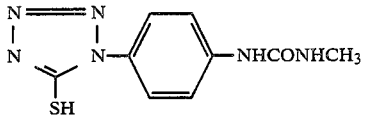
Cpd-22
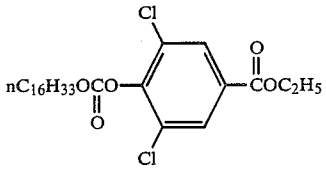
Cpd-23
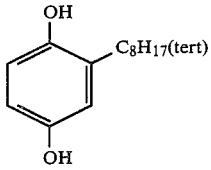
Cpd-24
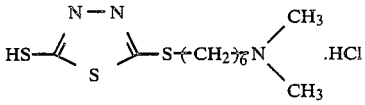
ExC-1
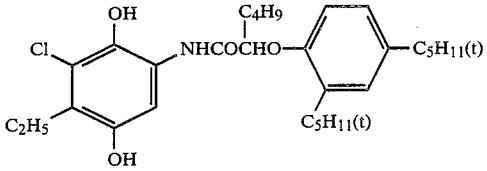
ExC-2
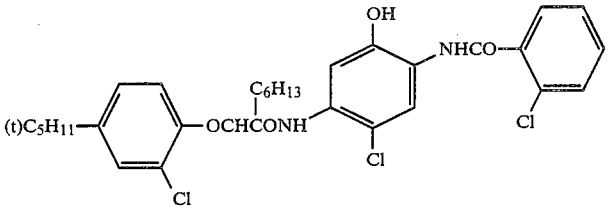
ExM-1
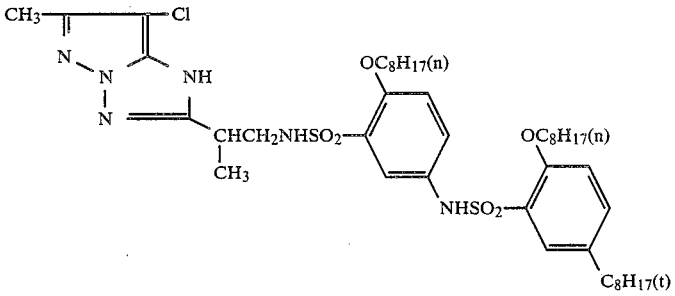

-continued

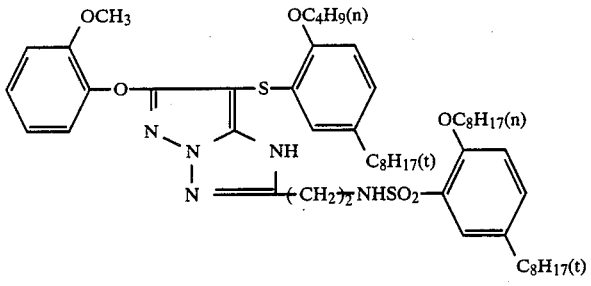

ExM-2

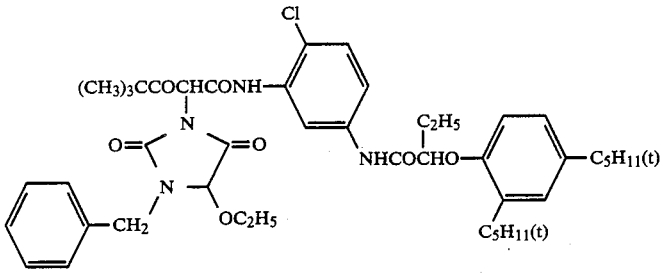

ExY-1

| | |
|---|---|
| Di(2-ethylhexyl)phthalate | Solv-1 |
| Trinonylphosphate | Solv-2 |
| Di(3-methylhexyl)phthalate | Solv-3 |
| Tricresyl phosphate | Solv-4 |
| Dibutyl phthalate | Solv-5 |
| Trioctyl phosphate | Solv-6 |
| Di(2-ethylhexyl)sebacate | Solv-7 |
| A mixture of 1,2-bis(vinylsulfonylacetamido)-ethane and 2,4,6-trichloro-1,3,5-triazine (1/1 molar ratio) | H-1 |

Preparation of Emulsions 1 to 3:

The emulsion for each light-sensitive layer was prepared in the same manner as described for Emulsion EM-A used in Comparative Sample-A except adding the metal compound described in Table 1 below during the formation of core grains.

TABLE 1

| Emulsion | Metal Compound | Amount Added* (mol/mol Ag) |
|---|---|---|
| EM-1 | Lead acetate | $5.0 \times 10^{-5}$ |
| EM-2 | Potassium chloroindiumate | $4.0 \times 10^{-6}$ |
| EM-3 | Zinc nitrate | $4.0 \times 10^{-3}$ |

*per mol of silver contained in the grains after the shell formation.

Direct Positive Color Photographic Light-Sensitive Material Nos. 1 to 11 were prepared in the same manner as described for Comparative Sample-A except using the emulsion shown in Table 2 below.

Each of the above-described samples was subjected to wedge exposure (0.1 second, 10 CMS, using a halogen lamp at 3,200° K.) and then development processing according to Processing Method A described below.

Magenta color image density of each sample thus-processed was measured. The maximum image density (Dmax), the minimum image density (Dmin), and the gradient at the toe region (an average gradient from a point of density of Dmin +0.1 to a point of density of Dmin +0.6) are shown in Table 2 below.

| Processing Method A: | | |
|---|---|---|
| Processing Step | Time (sec) | Temperature (°C.) |
| Color Development | 90 | 38 |
| Bleach-Fixing | 40 | 33 |

-continued

| Processing Method A: | | |
|---|---|---|
| Processing Step | Time (sec) | Temperature (°C.) |
| Washing with Water (1) | 40 | 33 |
| Washing with Water (2) | 40 | 33 |
| Washing with Water (3) | 15 | 33 |
| Drying | 30 | 80 |

The composition of each processing solution used was as follows.

| Color Developing Solution: | Tank Solution |
|---|---|
| Ethylenediaminetetramethylene-phosphonic Acid | 0.5 g |
| Diethylene Glycol | 10 ml |
| Benzyl Alcohol | 12.0 ml |
| Potassium Bromide | 0.65 g |
| Sodium Sulfite | 2.4 g |
| N,N-Diethylhydroxylamine | 4.0 g |
| Triethylenediamine (1,4-diazabicyclo-[2,2,2]octane) | 4.0 g |
| N-Ethyl-N-(β-methanesulfonamidoethyl)-3-methylaniline Sulfate | 5.6 g |
| Potassium Carbonate | 27.0 g |
| Fluorescent Whitening Agent (aminostilbene type) | 1.0 g |
| Water to make | 1,000 ml |
| pH (at 25° C.) | 10.50 |

| Bleach-Fixing Solution | Tank Solution |
|---|---|
| Disodium Ethylenediaminetetraacetate Dihydrate | 4.0 g |
| Ammonium Iron(III) Ethylenediamine-tetraacetate Dihydrate | 46.0 g |
| Ammonium Thiosulfate (700 g/liter) | 155 ml |
| Sodium p-Toluenesulfinate | 20.0 g |

-continued

| | |
|---|---|
| Sodium Bisulfite | 12.0 g |
| Ammonium Bromide | 50.0 g |
| Ammonium Nitrate | 30.0 g |
| Water to make | 1,000 ml |
| pH (at 25° C.) | 6.20 |

Washing Water (both tank solution and replenisher)

City water was passed through a mixed bed type column filled with an H type strong acidic cation exchange resin (Amberlite IR-120B manufactured by Rohm & Haas Co.) and an OH type anion exchange resin (Amberlite IR-400 manufactured by Rohm & Haas Co.) to prepare water containing not more than 3 mg/liter of calcium ion and magnesium ion. To the water thus-treated were added sodium dichloroisocyanurate in an amount of 20 mg/liter and sodium sulfate in an amount of 1.5 g/liter. The pH of the solution was in a range from 6.5 to 7.5.

TABLE 2

| No. | Emulsion | Nucleating Agent | Photographic Performance Dmax | Dmin | Gradient | Remarks |
|---|---|---|---|---|---|---|
| 1 | EM-1 and Similar Emulsion | N-I-25 | 2.4 | 0.10 | 2.1 | Invention |
| 2 | EM-1 and Similar Emulsion | N-I-23 | 2.4 | 0.10 | 2.0 | " |
| 3 | EM-1 and Similar Emulsion | N-A | 2.0 | 0.10 | 1.3 | Comparison |
| 4 | EM-2 and Similar Emulsion | N-I-25 | 2.4 | 0.10 | 2.0 | Invention |
| 5 | EM-2 and Similar Emulsion | N-I-23 | 2.3 | 0.10 | 1.9 | " |
| 6 | EM-2 and Similar Emulsion | N-A | 2.0 | 0.10 | 1.2 | Comparison |
| 7 | EM-3 and Similar Emulsion | N-I-25 | 2.4 | 0.10 | 1.9 | Invention |
| 8 | EM-3 and Similar Emulsion | N-I-23 | 2.4 | 0.10 | 1.9 | " |
| 9 | EM-3 and Similar Emulsion | N-A | 2.0 | 0.10 | 1.2 | Comparison |
| 10 | EM-A | N-I-25 | 2.3 | 0.10 | 1.5 | Comparison |
| 11 | " | N-A | 1.8 | 0.10 | 1.2 | Comparison |

Amount of nucleating agent added: $5 \times 10^{-6}$ mol/mol Ag
Nucleating Agent N-A: 6-Ethoxythiocarbonylamino-2-methyl-1-propargylquinolinium trifluoromethanesulfonate From the results shown in Table 2, it is apparent that Sample Nos. 1, 2, 4, 5, 7, and 8 using the internal latent image type emulsion and the nucleating agent according to the present invention are preferred in view of the high gradient as compared with Sample Nos. 3, 6, 9, 10, and 11 for comparison, and further they are preferred in view of the high Dmax in comparison with Sample Nos. 3, 6, 9, and 11. Similar results were obtained with respect to cyan and yellow color image densities.

EXAMPLE 2

The procedure with Sample No. 1 described in Example 1 was repeated except using Nucleating Agent (N-I-14), (N-I-15), (N-I-16), (N-I-18), (N-I-10), or (N-I-24) in place of Nucleating Agent (N-I-25), and similar results were obtained.

EXAMPLE 3

Preparation of Emulsion X-1:

An aqueous solution cf silver nitrate and an aqueous solution of potassium bromide were simultaneously added at constant rate to a gelatin aqueous solution (pH: 5.5) containing 20 mg per liter of thioether (1,8-dihydroxy-3,6-dithiaoctane) and $2.5 \times 10^{-6}$ mol of lead nitrate per mol of the total amount of silver after the formation of the shell under thoroughly stirring at 75° C. while maintaining the silver electrode potential constantly at a rate of addition such that silver nitrate corresponding to $\frac{5}{8}$ mol was added for 5 minutes to obtain a spherical monodispersed silver bromide emulsion having an average grain diameter of about 0.14 μm. 20 mg of sodium thiosulfate and 20 mg of chloroauric acid (4 hydrate) were added to the emulsion per mol of silver halide and the pH was adjusted at 7.5, followed by heating at 75° C. for 80 minutes with thoroughly stirring to effect chemical sensitization. The thus-obtained silver bromide grains were used as cores, an aqueous solution of silver nitrate (containing $\frac{7}{8}$ mols of silver nitrate) and an aqueous solution of potassium bromide were added simultaneously under thoroughly stirring at the same temperature as above over a period of 40 minutes while maintaining the silver electrode potential so as to grow octahedral grains in order to grow the shell whereby a cubic monodispersed core/shell type silver bromide emulsion having an average grain diameter of about 0.3 μm was obtained. The pH of the emulsion was adjusted at 6.5 and 5 mg of sodium thiosulfate and 5 mg of chloroauric acid (4 hydrate) were added thereto per mol of silver halide, followed by ripening at 75° C. for 60 minutes to effect chemical sensitization of the surface of the shell to finally obtain an internal image type octahedral monodispersed core/shell silver bromide emulsion (Emulsion X-1). As a result of measurement on grain size distribution of the emulsion using electron microscopic photographs, it was found that the average grain diameter was 0.30 μm and the coefficient of variation (percent of a value obtained by dividing a statistical standard deviation with the above-described average grain diameter) was 10%.

Preparation of Emulsions X-2 to, X-5:

Emulsions X-2 to X-5 were prepared in the same manner as described for Emulsion X-1 except adding the metal salts shown in Table 3 below in place of lead nitrate. Grain size and size distribution crystal habit of these emulsions were the same as those of Emulsion X-1.

Preparation of Comparative Emulsion B:

Comparative Emulsion B was prepared in the same manner as described for Emulsion X-1 except that lead nitrate was not employed.

TABLE 3

| Emulsion | Metal Salt | Amount Added* (mol) |
|---|---|---|
| X-1 | Lead Nitrate | $2.5 \times 10^{-6}$ |

TABLE 3-continued

| Emulsion | Metal Salt | Amount Added* (mol) |
|---|---|---|
| X-2 | " | $2.5 \times 10^{-4}$ |
| X-3 | Cadmium Chloride | $3.0 \times 10^{-3}$ |
| X-4 | Bismuth Nitrate | $4.0 \times 10^{-4}$ |
| X-5 | Lead Acetate | $2.5 \times 10^{-5}$ |
| B | — | — |

*per mol of the total silver after the shell formation

To each of Emulsions X-1 to X-5 and B was added, as a panchromatic sensitizing dye, 5 mg of 3,3-diethyl-9-methylthiacarbocyanine per mol of silver halide, and then was added $1.4 \times 10^{-5}$ mol of the nucleating agent shown in Table 4 below, per mol of silver halide. The coating solution thus-prepared was coated on a polyethylene terephthalate film support so as to be a silver coating amount of 2.8 g/m$^2$ simultaneously with a protective layer composed of gelatin and a hardening agent. Thus, Direct Positive Photographic Light-Sensitive Material Samples No.1 to No. 13 each being sensitive to up to red light were prepared.

These samples were stored in an atmosphere of 40° C. and 80% RH for 3 days (incubation test). Then, each of these samples was exposed through a step wedge using a sensitometer equipped with a tungsten lamp of 1 kw (color temperature: 2,854° K.) for 0.1 second. Thereafter, each sample was developed at 36° C. for 18 seconds by an automatic developing machine (Kodak Proster I Processor) using Kodak Proster Plus Processing Solution (developing solution: pH of 10.7), followed by washing with water, fixing and washing with water step by the same processor and dried. The maximum density and the minimum density of the direct positive image thus-formed in each sample were measured. The results are shown in Table 4 below.

TABLE 4

| No. | Emulsion | Nucleating Agent | Dmax | Dmin | Remarks |
|---|---|---|---|---|---|
| 1 | X-1 | N-I-24 | 2.56 | 0.05 | Invention |
| 2 | " | N-I-25 | 2.58 | 0.05 | " |
| 3 | X-2 | " | 2.56 | 0.05 | " |
| 4 | X-3 | " | 2.56 | 0.05 | " |
| 5 | X-4 | " | 2.57 | 0.05 | " |
| 6 | X-5 | " | 2.58 | 0.05 | " |
| 7 | B | " | 2.14 | 0.07 | Comparison |
| 8 | X-1 | N-A | 2.08 | 0.07 | " |
| 9 | X-2 | " | 2.06 | 0.07 | " |
| 10 | X-3 | " | 2.07 | 0.07 | " |
| 11 | X-4 | " | 2.06 | 0.07 | " |
| 12 | X-5 | " | 2.05 | 0.07 | " |
| 13 | B | " | 2.01 | 0.07 | " |

Amount added of nucleating agent: $3.5 \times 10^{-6}$ mol/mol Ag

It is apparent from the results shown in Table 4 that Sample Nos. 1 to 6 using both the silver halide emulsion and the nucleating agent according to the present invention exhibit preferably high Dmax and low Dmin after the incubation test in comparison with Comparative Sample Nos. 7 to 13.

EXAMPLE 4

Photographic light-sensitive materials were prepared in the same manner as described in Example 3 except adding $1.6 \times 10^{-4}$ mol cf Cpd-24 used in Example 1 per mol of silver. These photographic materials were subjected to light exposure and development processing in the same manner as described in Example 3 except changing the developing temperature to 34° C. Similar results to those in Example 3 were obtained.

EXAMPLE 5

Preparation of Core/Shell Type Direct Positive Emulsion P

An aqueous solution of potassium bromide and an aqueous solution of silver nitrate were simultaneously added at 75° C. over a period of about 60 minutes with vigorous stirring to an aqueous gelatin solution to obtain a silver bromide emulsion. Before the precipitation, 100 mg of 3,4-dimethyl-1,3-thiazoline-2-thione per mol of silver, 15 g of benzimidazole per mol of silver and $1 \times 10^{-5}$ mol of lead acetate per mol of silver after the formation of shell were added to the precipitation vessel. After the completion of the precipitation, silver bromide crystals having an average grain diameter of about 1.1 μm were formed. Then, 5.4 mg of sodium thiosulfate per mol of silver and 3.9 mg of potassium chloroaurate per mol of silver were added to the silver bromide emulsion and the emulsion was heated at 75° C. for minutes to be chemically sensitized. The thus chemically sensitized silver bromide grains were used as cores and to the emulsion were added simultaneously an aqueous solution of potassium bromide and an aqueous solution of silver nitrate over a period of 40 minutes in the same manner as the first step described above, to prepare a core/shell emulsion. The final average grain diameter of the emulsion was 1.5 μm.

To the core/shell type emulsion were added 0.32 mg of sodium thiosulfate per mol of silver and 57 mg of poly(N-vinylpyrrolidone) per mol of silver and the emulsion was heated at 60° C. for 60 minutes to be chemically sensitized on the surface of grains, whereby Emulsion P was prepared.

Comparative Emulsion C was prepared in the same manner as described for Emulsion P except that lead acetate was not employed.

Preparation of Light-Sensitive Sheet A

On a polyethylene terephthalate transparent film support, Layer 1 to Layer 6 were coated according to the layer structure shown below to prepare Light-Sensitive Sheet A.

Layer 6: Protective layer containing gelatin

Layer 5: Red-sensitive core/shell type direct positive emulsion layer

Layer 4: Layer containing a cyan DRR compound

Layer 3: Light shielding layer

Layer 2: White light reflective layer

Layer 1: Mordant layer

Support

Layer 1: Mordant layer containing a copolymer having the repeating unit described below in the ratio described below:

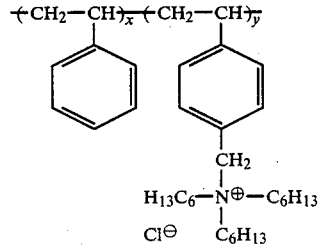

x:y = 50:50 x/y=50/50 which is described in U.S. Pat. No. 3,898,088 (3.0 g/m²) and gelatin (3.0 g/m²)

Layer 2: White light reflective layer containing titanium oxide (20 g/m²) and gelatin (2.0 g/m²)

Layer 3: Light shielding layer containing carbon black (2.0 g/m²) and gelatin (1.5 g/m²)

Layer 4: Layer containing a cyan DRR compound described below (0.44 g/m²), tricyclohexyl phosphate (0.09 g/m²) and gelatin (0.8 g/m²)

On a polyethylene terephthalate transparent film support, Layer 1' to Layer 3' described below were coated in this order to prepare a color sheet.

Layer 1': Neutralizing layer containing a copolymer of acrylic acid and butyl acrylate (weight ratio: 80/20) (22 g/m²) and 1,4-bis(2,3-epoxypropoxy)butane (0.44 g/m²)

Layer 2': Layer containing acetyl cellulose (as modified by hydrolysis of 100 g acetyl cellulose to form

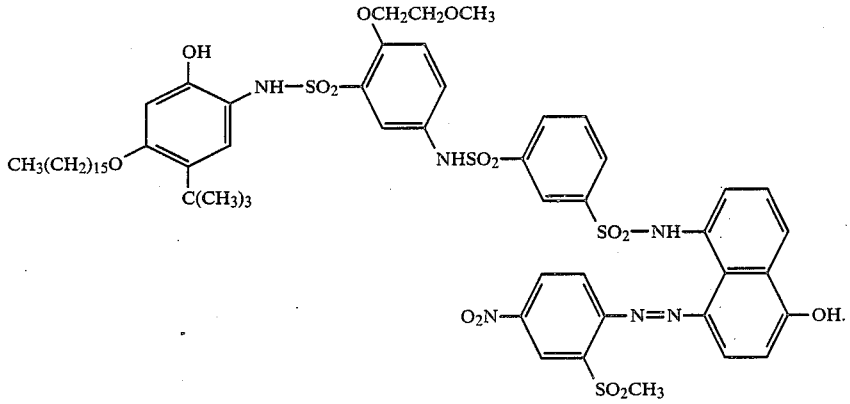

Layer 5: Red-sensitive core/shell type direct positive silver bromide emulsion layer containing Emulsion P described above (0.81 g/m² as silver), a red-sensitizing dye ExS-2 used in Example 1, a compound shown in Table 5 below as a nucleating agent, 4-hydroxy-6-methyl-1,3,3*a*,7-tetraazaindene (4.3 mg/m²) and sodium 5-pentadecylhydroquinone-2-sulfonate (0.11 g/m²)

Layer 6: Protective layer containing gelatin (1.0 g/m²)

Further, Light-Sensitive Sheets B to F were prepared in the same manner as described for Light-Sensitive Sheet A above except adding the compound represented by the formula (N-1) according to the present invention shown in Table 5 below to the red-sensitive emulsion layer (Layer 5).

Light-Sensitive Sheets A to F thus-prepared were stored under conditions of 45° C. and 75% RH for days to conduct a forced storage test (incubation test.

The above-described light-sensitive sheets subjected to the forced storage test and those not subjected were exposed to light and developed in combination with the elements shown below to evaluate photographic properties (Dmax and Dmin).

| Processing Solution: | |
|---|---|
| 1-p-Tolyl-4-methyl-4-hydroxymethyl-3-pyrazolidone | 12.0 g |
| Methylhydroquinone | 0.3 g |
| 5-Methylbenzotriazole | 3.5 g |
| Sodium Sulfite | 2.0 g |
| Sodium Salt of Carboxymethyl Cellulose | 58 g |
| Potassium Hydroxide | 56 g |
| Benzyl Alcohol | 1.5 g |
| Carbon Black Dispersion (25%) | 600 g |
| Water to make | 1 kg |

0.8 g portions of the processing solution having the above-described composition were retained in "pressure-rupturable containers".

Cover Sheet:

39.4 g of acetyl group (3.8 g/m²), a copolymer of styrene and maleic anhydride (weight ratio: 60/40, molecular weight: about 50,000) (0.2 g/m²) and 5-(β-cyanoethylthio)-1-phenyltetrazole (0.115 g/m²)

Layer 3': Layer containing a copolymer latex of vinylidene chloride, methyl acrylate and acrylic acid (weight ratio: 85/12/3) (2.5 g/m²) and polymethyl methacrylate latex (particle size: 1 to 3 μm) (0.05 g/m²)

Exposure to Light and Development Processing

The above-described cover sheet was superposed on each of the above-described light-sensitive sheets, and image exposure was conducted through a continuous gradation wedge from the cover sheet side. Then, the above-described processing solution was spread in a thickness of 75 μm between these two sheets using pressure-applying rollers. The spread processing was conducted at 25° C. One hour after the processing, cyan color density of the image transferred on the mordant layer (image-receiving layer) was measured through the transparent support of the light-sensitive sheet by a shown in Table 5 below.

TABLE 5

| No. | Emulsion | Nucleating Agent | Before Incubation Dmax | Before Incubation Dmin | After Incubation Dmax | After Incubation Dmin | Remarks |
|---|---|---|---|---|---|---|---|
| | P | N-I-15 | 2.30 | 0.33 | 2.28 | 0.33 | Invention |
| 2 | " | N-I-16 | 2.35 | 0.33 | 2.30 | 0.33 | Invention |
| 3 | " | N-I-23 | 2.32 | 0.32 | 2.30 | 0.32 | Invention |
| 4 | " | N-I-25 | 2.35 | 0.32 | 2.32 | 0.32 | Invention |
| 5 | " | N-A | 2.18 | 0.39 | 1.75 | 0.45 | Comparison |
| 6 | C | N-I-15 | 2.21 | 0.38 | 1.95 | 0.42 | Comparison |
| 7 | " | N-I-16 | 2.20 | 0.38 | 1.96 | 0.42 | Com- |

TABLE 5-continued

| No. | Emulsion | Nucleating* Agent | Before Incubation Dmax | Before Incubation Dmin | After Incubation Dmax | After Incubation Dmin | Remarks |
|---|---|---|---|---|---|---|---|
| | | | | | | | parison |
| 8 | " | N-I-23 | 2.18 | 0.39 | 1.89 | 0.42 | Comparison |
| 9 | " | N-I-25 | 2.15 | 0.38 | 1.88 | 0.41 | Comparison |
| 10 | " | N-A | 2.14 | 0.39 | 1.54 | 0.46 | Comparison |

*Amount added of nucleating agent: $1.5 \times 10^{-6}$ mol/mol Ag

It is apparent from the results shown in Table 5 that Sample Nos. 1 to 4 according to the present invention exhibit preferably high Dmax and low Dmin as well as small decrease in Dmax and increase in Dmin in comparison with Comparative Sample Nos. 5 to 10.

As described in detail above, direct positive photographic light-sensitive materials which provide sufficiently high maximum image density and low minimum density as well as high gradient at the toe region can be obtained according to the present invention. In addition, the above-described effects are remarkably exhibited even when the photographic light-sensitive materials are stored under high temperature and high humidity conditions. Accordingly, they are of large merit for practical purpose.

While the invention has been described in detail and with reference to specific embodiments thereof, it will be apparent to one skilled in the art that various changes and modifications can be made therein without departing from the spirit and scope thereof.

What is claimed is:

1. A direct positive photographic light-sensitive material comprising: (1) a support, (2) at least one photographic emulsion layer containing internal latent image type silver halide grains not having been previously fogged, wherein the internal latent image type silver halide grains are silver bromide, silver chloride, silver iodobromide, silver chlorobromide or silver chloroiodobromide grains in which at least one metal selected from manganese, copper, zinc, cadmium, lead, bismuth, indium, thallium, zirconium, lanthanum, chromium, rhenium, and metals of group VIII of the Periodic Table is incorporated, and (3) at least one compound represented by the following formula (N-1):

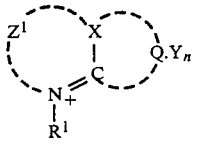

(N-1)

wherein $Z^1$ represents a nonmetallic atomic group necessary to form a 5-membered or 6-membered heterocyclic ring to which an aromatic ring or a heterocyclic ring may further be condensed; $R^1$ represents an aliphatic group; X represents $$=\underset{|}{C}- \quad \text{or} \quad -\underset{|}{N}-;$$

Q represents a nonmetallic atomic group necessary to form a 4-membered to 12-membered nonaromatic hydrocarbon ring or nonaromatic heterocyclic ring; at least one of $R^1$, a substituent for $Z^1$ and a substituent for Q includes an alkynyl group; Y represents a counter ion necessary for charge balance; and n represents a number necessary to balance a charge.

2. A direct positive photographic light-sensitive material as claimed in claim 1, wherein the internal latent image type silver halide grains are those having a core/shell stratified form.

3. A direct positive photographic light-sensitive material as claimed in claim 2, wherein a core and shell of the silver halide grains ar composed of silver bromide, silver iodobromide, silver chlorobromide or silver chloroiodobromide each containing silver bromide and not more than 10 mol% of silver iodide.

4. A direct positive photographic light-sensitive material as claimed in claim 1, wherein the metal is selected from manganese, copper, zinc, cadmium, lead, bismuth, and metals of group VIII of the Periodic Table.

5. A direct positive photographic light-sensitive material as claimed in claim 4, wherein an amount of the metal incorporated into the silver halide grains is from to $10^{-9}$ to $10^{-2}$ mol per mol of silver halide.

6. A direct positive photographic light-sensitive material as claimed in claim 2, wherein the metal is present in the core of the core/shell stratified grain.

7. A direct positive photographic light-sensitive material as claimed in claim 1, wherein the photographic emulsion layer is a monodispersed silver halide emulsion layer.

8. A direct positive photographic light-sensitive material as claimed in claim 1, wherein the heterocylclic ring completed with $Z^1$ is a quinolinium nucleus, a benzimidazolium nucleus, a pyridinium nucleus, a thiazolium nucleus, a selenazolium nucleus, an imidazolium nucleus, a tetrazolium nucleus, an indolenium nucleus, a pyrrolinium nucleus, an acridinium nucleus, a phenanthridinium nucleus, an isoquinolium nucleus, and a naphthopyridinium nucleus.

9. A direct positive photographic light-sensitive material as claimed in claim 1, wherein the aliphatic group represented by $R^1$ is an alkynyl group.

10. A direct positive photographic light-sensitive material as claimed in claim 1, wherein the nonaromatic hydrocarbon ring completed with Q is selected from a cyclopentane ring, a cyclohexane ring, a cyclohexene ring, a cycloheptane ring, an indan ring and a tetralin ring.

11. A direct positive photographic light-sensitive material as claimed in claim 1, wherein the nonaromatic heterocyclic ring completed with Q is selected from a tetrahydrofuran ring, a tetrahydropyran ring, a butyrolactone ring, a pyrrolidone ring, a tetrahydrothiophene ring, a pyrrolidine ring, a piperidine ring, a pyridone ring, a piperazine ring, a perhydrothiazine ring, a tetrahydroquinoline ring and an indoline ring.

12. A direct positive photographic light-sensitive material as claimed in claim 1, wherein the alkynyl group which is present in $R^1$, a substituent for $Z^1$ or a substituent for Q is an alkynyl group having from 2 to 18 carbon atoms.

13. A direct positive photographic light-sensitive material as claimed in claim 1, wherein at least one of $R^1$, $Z^1$ and Q include a group capable of accelerating adsorption onto silver halide grains.

14. A direct positive photographic light-sensitive material as claimed in claim 13, wherein the group capable of accelerating adsorption is represented by the following general formula:

$$X^1(L^1)_m$$

wherein $X^1$ represents a group capable of accelerating adsorption onto silver halide grains; $L^1$ represents a divalent linking group; and m represents 0 or 1.

15. A direct positive photographic light-sensitive material as claimed in claim 14, wherein the group capable of accelerating adsorption is a thioamido group, a mercapto group or a 5-membered or 6-membered nitrogen-containing heterocyclic group.

16. A direct positive photographic light-sensitive material as claimed in claim 15, wherein the 5-membered or 6-membered nitrogen-containing heterocyclic group is one which will form an imino silver.

17. A direct positive photographic light-sensitive material as claimed in claim 14, wherein the divalent linking group represented by $L^1$ is selected from an alkylene group, an alkenylene group, an alkynylene group, an arylene group, -O-, -S-, -NH-, -N=, -CO-, $-SO_2-$, and a combination thereof, all of which groups are unsubstituted or substituted with one or more substituents.

18. A direct positive photographic light-sensitive material as claimed in claim 1, wherein the compound represented by the formula (N-1) is present in a silver halide emulsion layer or a hydrophilic colloid layer adjacent thereto.

19. A direct positive photographic light-sensitive material as claimed in claim 18, wherein the compound is present in a silver halide emulsion layer.

20. A direct positive photographic light-sensitive material as claimed in claim 1, wherein the photographic light-sensitive material further contains a color coupler.

21. A direct positive photographic light-sensitive material as claimed in claim 1, wherein the photographic light-sensitive material further contains a nucleating accelerating agent.

22. A direct positive photographic light-sensitive material as claimed in claim 21, wherein the nucleation accelerating agent is a compound selected from a triazaindene, a tetraazaindene and a pentaazaindene each having at least one mercapto group.

* * * * *